US007309190B1

(12) United States Patent
Sullivan

(10) Patent No.: US 7,309,190 B1
(45) Date of Patent: Dec. 18, 2007

(54) SHORING DEVICE WITH REMOVABLE SWIVEL SIDE PLATES CONTAINING DETENTE SPHERE ATTACHMENTS

(76) Inventor: James G. Sullivan, 10013 Norwood, Rosemont, IL (US) 60018

( * ) Notice: Subject to any disclaimer, the term of this patent is extended or adjusted under 35 U.S.C. 154(b) by 222 days.

(21) Appl. No.: 11/273,606

(22) Filed: Nov. 14, 2005

Related U.S. Application Data

(63) Continuation-in-part of application No. 10/826,093, filed on Apr. 16, 2004, now Pat. No. 6,964,542, which is a continuation-in-part of application No. 10/252,255, filed on Sep. 23, 2002, now Pat. No. 6,746,183.

(51) Int. Cl.
*E02D 17/08* (2006.01)

(52) U.S. Cl. ..... 405/278; 405/272

(58) Field of Classification Search ..... 405/272, 405/282, 283; 403/109.3
See application file for complete search history.

(56) References Cited

U.S. PATENT DOCUMENTS 3,362,168 A * 1/1968 Dotlich ..... 405/283
3,851,856 A * 12/1974 Berg ..... 405/282
4,752,157 A * 6/1988 Ischebeck et al. ..... 405/282
4,787,781 A * 11/1988 Bradberry ..... 405/282
5,310,290 A * 5/1994 Spencer ..... 405/283
5,503,504 A * 4/1996 Hess et al. ..... 405/282
6,394,405 B1 * 5/2002 Roxton et al. ..... 248/354.1
6,746,183 B1 * 6/2004 Sullivan ..... 405/282
6,964,542 B1 * 11/2005 Sullivan ..... 405/282

* cited by examiner

*Primary Examiner*—Frederick L. Lagman
(74) *Attorney, Agent, or Firm*—Adrienne B. Naumann, Esq.

(57) ABSTRACT

A shoring device is disclosed comprising a piston and a cylinder. The piston is axially expanded by compressed gas, whereby the shoring device engages two opposing surfaces. Removable swivel sideplates comprise détente sphere attachments by which the sideplates reversibly attach to the piston and cylinder. These attached removable swivel sideplates contain set screws which engage the sides of trenches and excavations which are lined with timbers or other materials.

7 Claims, 11 Drawing Sheets

SHORING DEVICE WITH REMOVABLE SWIVEL SIDE PLATES CONTAINING DETENTE SPHERE ATTACHMENTS

This application is a continuation in part of U.S. application Ser. No. 10/826,093 filed Apr. 16, 2004 now U.S. Pat. No. 6,964,542 which is a continuation in part of application Ser. No. 10/252,255 filed Sep. 23, 2002, now U.S. Pat. No. 6,746,183 B1.

BACKGROUND OF THE INVENTION

My invention relates to a shoring device comprising a piston, cylinder and removable swivel side plates combined with either an (i) inner ratcheting ring or (ii) pin and collar ring. More particularly, this invention relates to a shoring device with two removable side plates which attach to a cylinder and/or piston with a détente sphere attachment. Each détente sphere inserts within a corresponding aperture of a piston or cylinder. These removable swivel side plates with détente sphere attachments insure reliable attachment to the cylinder and piston without the expense, extra weight and handling of détente pins or other attaching and connecting devices.

In experimental trials, my pneumatic shoring device withstood pneumatic pressures within the cylinder of at least 300 psi (pounds per square inch) for a minimum of fifteen seconds. My new device is intended for, but not exclusively, public works and construction, rescue and other projects in which shoring is necessary.

As workers shore trenches, they must quickly install shoring to prevent collapse of the trench walls. If shoring is not installed, soil cohesion is lost and it becomes almost impossible to maintain a safe trench. The prior art as best depicted in expired U.S. Pat. No. 3,851,856(Berg) provided a shoring device with an inlet connecting to a pressure source for expanding the device tightly against trench walls. There is also a rotational outer ratcheting ring mounted on one cylinder end, which receives the piston. This rotational outer ratcheting ring extends axially from the cylinder and surrounds a proximal piston end.

Still referring to the Berg device, the rotational member is prevented from rotation in part by a cam-like ridge along the proximal member edge. Subsequent to cylinder pressurization the piston remains extended by securing the cam-like ridge on the rotational member with an abutting cam pin. However the only structure in Berg's device which prevents the piston from random axial movement projectile is a small diameter pin. This small diameter pin penetrates the rotational member and abuts the cylinder, after the abutting cam pin is already in place. The small diameter pin end abuts the cylinder, and can be further tightened against the cylinder by a t-bolt.

Berg does not disclose removable swivel side plates which (i) attach to the piston or cylinder with a spring biased détente sphere; and which (ii) reversibly protrude within corresponding cylinder or piston apertures. In contrast, my new shoring device comprises removable swivel side plates, each with a single, or two opposing détente sphere attachments. In one prototype an inner ratcheting ring preferably attaches to the cylinder with allen screws (threaded with hexagonal head depressions), as well as by a circular metal lip which engages one cylinder end. The inner ratcheting ring reduces the likelihood that the piston becomes a projectile. This safety feature occurs because the piston abuts the inner lip, and so the piston cannot move laterally. This outer ratcheting collar is described in detail in U.S. Pat. No. 6,746,183 B1.

The outer removable ratcheting collar encloses the inner ratcheting ring and interlocks with inner ratcheting ring serrations. Outer ratcheting collar preferably comprises one rectangular protrusion which interlocks with the inner serrated ring. This interlocking prevents counter-clockwise rotation of the outer ratcheting collar, thereby preventing collapse of the piston upon the ground or floor.

With respect to the pin and collar shoring device, described previously in application Ser. No. 10/826,093, a continuous circular indentation prevents the flat threaded pin furthermost point from skidding along the cylinder surface. The cylinder is not weakened by repeated contract, because the outer cam collar provides the direct contact surface. My outer cam collar is more economical to replace, and protects the cylinder from wear and tear from the threaded pin.

In addition, my inner pin and collar shoring device comprises a continuous circular lip which abuts the piston and prevents it from falling from the cylinder or becoming a projectile during operation. My new inner ring engages one cylinder end, thereby reducing the possibility that the piston will fall from the cylinder during operation. This metal lip abuts the piston to prevent piston lateral movement, which is an important safety advantage which over Berg's device.

The modified pin collar shoring device also comprises the same removable swivel side plates with détente sphere attachments which (i) contain small spring biased détente spheres, and (ii) reversibly attach each removable swivel side plate without additional cumbersome détente pins or other attaching devices. With the pin and collar model, the outer cam collar encloses the inner ring and comprises the threaded pin which tightly abuts the circular continuous indentation. The cam edges, together with a straight metal cam pin, prevent counter-clockwise rotation of the outer cam collar. This improved pin and collar shoring device is engineered to assist underground workers in compliance with the OSHA regulation governing excavations, i.e., 29 C.F.R. 1926.650. In sum, this new shoring device, in either prototypes and with either a single or an opposing pair of détente sphere attachments, solves a problem in the art which Berg does not resolve.

Shoring is the placement of cross bracing and other components within a trench to support trench walls. There are two important theories of shoring: first is the theory of "zero-movement", in which shoring is designed to prevent wall movement. Shoring is not sufficiently strong to retain a moving wall of soil: it merely prevents a soil wall from initially moving. The second theory of shoring is designated the "Arch Effect." Shoring is effective because it creates forces as it pushes again trench walls. The network of cross braces and uprights or wale-plates creates an arch effect which retains soil. The shoring and cross bracing actually retains soil, and not the plywood or sheeting.

An operator applies plywood or sheeting to prevent surface soil from falling and injuring a worker. To achieve "zero movement" and the "arch effect," all gaps and voids must be filled where the cross brace bears on the trench wall. Other than the mandatory inspection for damage before each use and an occasional cleaning, there are no maintenance requirements.

My preferred pneumatic shoring devices (comprising either a pin collar or outer ratcheting collar) with détente sphere attachments, also comprises a contiguous pressurized gas channel through the cylinder to the piston. In the best mode, this contiguous pressurized gas channel includes a circular channel segment along the lower floor surface of a cylinder rubber end cup.

SUMMARY OF THE INVENTION

My improved shoring device is much safer, yet is more cost effective than, the prior art. The new crucial safety feature comprises removable swivel side plates with integral détente sphere attachments. In these attachments, spring activated détente spheres replace cumbersome, expensive détente pins of previous prototypes. Each detente sphere permanently lodges within a circular depression of the exterior wall of each removable swivel side plate. Each détente sphere also contacts a single small spring within the corresponding circular depression. There are also opposing notches which prevent each detente sphere from separating from the corresponding circular depression.

Whenever the spring-biased detente sphere is released, it rebounds and protrudes simultaneously from its circular depression and into a congruently aligned piston or cylinder aperture. The rebound results from tension in the attached spring which compresses whenever the détente sphere is manually pressed. When it protrudes into the aligned aperture, the detente sphere connects the removable swivel side plate to the cylinder or piston. When depressed the detente sphere retracts from the cylinder or piston aperture. The removable swivel side plate which comprises the detente sphere attachment (or an opposing pair as the case may be) is then removed from, or inserted into, the piston or cylinder.

The shoring device with detente sphere attachments is engineered to assist underground workers in compliance with the OSHA regulation governing excavations in the pin and collar prototype. 29 C.F.R. 1926.650. This group includes, but is not limited to, sewer contractors, plumbers, gas companies, telephone companies, municipal public works departments and fire rescue services. The principle goal of my shoring device is to provide the necessary physical support which ensures a work environment safe from collapse.

In particular, shoring is the placement of crossbracing and other components within a trench to support trench walls. There are two important theories of shoring: first is the theory of "zero-movement", in which shoring is designed to prevent wall movement. Shoring is not sufficiently strong to retain a moving wall of soil: it merely prevents a soil wall from initially moving. The second theory of shoring is designated the "Arch Effect." Shoring is effective because it creates forces as it pushes again trench walls. The network of crossbraces and uprights or wale-plates creates an arch effect which retains soil. The shoring and crossbracing actually retains soil, and not the plywood or sheeting.

An operator applies plywood or sheeting to prevent surface soil from falling and injuring a worker. To achieve "zero movement" and the "arch effect," all gaps and voids must be filled where the crossbrace bears on the trench wall. Other than the mandatory inspection for damage before each use and an occasional cleaning, there are no maintenance requirements.

My preferred pneumatic shoring devices with détente sphere attachments also each comprise a contiguous pressurized gas channel through the cylinder to the piston. This contiguous pressurized gas channel includes a circular channel segment along the lower floor surface of a cylinder rubber endcup.

The piston is cylindrical and inserts within the larger diameter cylinder (which is also cylindrical in shape). The piston also comprises a plurality of aligned apertures, into which a metal camming pin inserts. This metal camming pin, in combination with a camming surface, prevents the piston from retracting into the cylinder, once the air pressure is removed. This metal camming pin provides initial adjustment whenever an operator rotates the outer ratcheting collar during installation of the ratcheting collar shoring device. Fine adjustment subsequently occurs whenever the outer ratcheting collar interlocks with the enclosed inner-ratcheting ring.

With respect to my pin and collar prototype, release of the outer cam collar in a counterclockwise direction requires the operator to manually twist the threaded pin counter-clockwise. This movement releases the pin from a continuous circular indentation along the inner ring exterior surface. The inner ring greatly reduces the likelihood that the piston will become a projectile, because a rubber piston cup attached to a cylinder plug cannot move beyond the continuous circular lip. The inner ring also comprises an inner circular continuous lip which abuts the distal piston end. The inner circular continuous lip prevents the piston from becoming a projectile.

Testing of my shoring device in the preferred pneumatic embodiment confirms that it is stronger than any conceivable soil load. See 29 C.F.R. 1926.652. For the outer ratcheting collar shoring device, the inner ratcheting ring comprises a plurality of serrations, and there is a corresponding locking protrusion within the outer ratcheting collar. The inner ratcheting ring encloses the proximal cylinder end, and this ring is further attached to the cylinder with at least two screws.

Also with the preferred outer ratcheting collar shoring device, engagement with inner ratcheting collar occurs automatically upon clockwise rotation of outer ratcheting collar. Release of outer ratcheting collar requires the operator's depression of a thumblock. In contrast, the interlocked position of the outer ratcheting collar requires no act by the operator. The initial lateral extension of my assembled improved shoring device occurs whenever pressurized air enters the cylinder during a trench application. For support of a car or building, my shoring device is manually extended until resistance is felt, and then the outer ratcheting collar is locked.

During removal of an installed shoring device with an outer ratcheting collar, there is counter-clockwise release of the outer ratcheting collar prior to removal of the air pressure. In actual field operations, air pressure is not removed from the shoring device until the operator has moved to a safe position removed from the device.

Each shoring device, with either a pin collar or outer ratcheting collar, comprises two removable swivel side plates, and each of these removable swivel side plates contains a single, or preferably two, opposing détente sphere attachments. One removable swivel side plates reversibly attaches to the most distal piston end by a protruding détente sphere, while the other removable swivel side plate similarly attaches to the most proximal cylinder end.

The removable swivel side plates also comprise adjustable set screws for engagement of wood shoring boards or aluminum wale-plates. Each preferred set screw is approximately ¼ inch in diameter, and comprises twenty threads per inch. Each preferred set screw is also approximately one inch in length. However, other side plates or end adapters are also within the scope of my invention, and may be even preferably for primarily vertical or angled applications, such as buildings or vehicles.

My preferred pneumatic shoring devices each comprise a cylinder plug. Cylinder plug is hollow at its proximal end to accommodate one removable swivel side plate. The remaining approximate one-half of the cylinder plug is solid metal and comprises a continuous channel for compressed air. A novel feature of my modified cylinder plug is a cylinder rubber endcup at its distal plug end. Cylinder rubber endcup more efficiently prevents air leaks from the air channel within metal cylinder plug. In the preferred embodiment, the cylinder endcup comprises apertures and a circular channel, which contribute to the most efficient airflow from cylinder plug distal end. More preferably, this air channel segment lies along the lower floor surface of the cylindrical rubber endcup.

This circular channel segment comprises a contiguous aperture through which pressurized air from a gas inlet evenly and quickly seals the raised edge of a piston rubber endcup. In contrast, the prior art comprises a circular groove around the circumference of the metal cylinder plug, and into which groove a rubber o-ring is inserted. The problem with this prior art approach is breakage of the o-ring upon metal groove edges, and subsequent leakage of air from the cylinder plug.

My improved shoring device, either with outer ratcheting collar or pin and collar assemblies, is assembled by inserting the piston so that its piston rubber endcup initially abuts cylinder rubber endcup. With the outer ratcheting collar prototype, the inner ratcheting ring is next inserted over the cylinder end until its circular metal lip engages the distal cylinder end. Inner ratcheting ring is then bolted to the cylinder. Outer ratcheting collar is next positioned so that it encloses the inner ratcheting ring.

The outer ratcheting collar has limited movement along the cylinder, but it can be manually rotated and then locked to inner serrated ring. At least approximately one-third of the longitudinal axial length of the piston must always remain within the cylinder. After the outer ratcheting collar fits over the inner serrated ring, the operator finally inserts the removable swivel side plates at the distal and proximal end of the shoring device.

In the best mode, the outer ratcheting collar prototype is assembled by inserting the piston so that its piston rubber end cup initially abuts cylinder rubber end cup. The inner ring is next inserted over the cylinder end until its circular metal inner lip engages the distal cylinder end. The operator then bolts the inner ring is then bolted to the cylinder. The outer cam collar is next positioned so that it encloses the inner ring.

With the outer ratcheting collar prototype, the outer cam collar has limited movement along the cylinder, but it can be manually rotated and then locked to the inner ring with a threaded pin. After the operator fits the outer ratcheting collar over the inner ratcheting ring, he or she finally inserts the removable swivel side plates at the distal and proximal end of the shoring device. The pin and collar prototype has similar features.

For pneumatic applications, my pin and collar shoring device is particularly suited for situations in which only one air pressure value is available. Any single specific air pressure value is generally in the range of approximately 115-150 psi (pounds per square inch), and the shoring device is manually extended until resistance is felt. Then the operator inserts a straight metal cam pin into appropriate piston apertures. He or she then manually tightens the outer cam collar by rotating the threaded pin until the threaded pin tightly abuts the continuous circular indentation.

For both the outer ratcheting collar, and pin and collar prototypes, at least approximately one-third of the longitudinal axial length of the piston must always remain within the cylinder.

Accordingly, it is a goal of my invention to provide more economical and less cumbersome removable side swivel plates, which comprise détente sphere attachments for shoring devices.

It is another goal of my invention to provide a quicker insertion, and attachment of, removable swivel side plates without additional components which are misplaced during an emergency.

These as well as other features of my device are described further in the drawings and the detailed description of the preferred embodiment and other embodiments

DETAILED DESCRIPTION OF THE PREFERRED EMBODIMENT AND OTHER EMBODIMENTS

Figure 2:
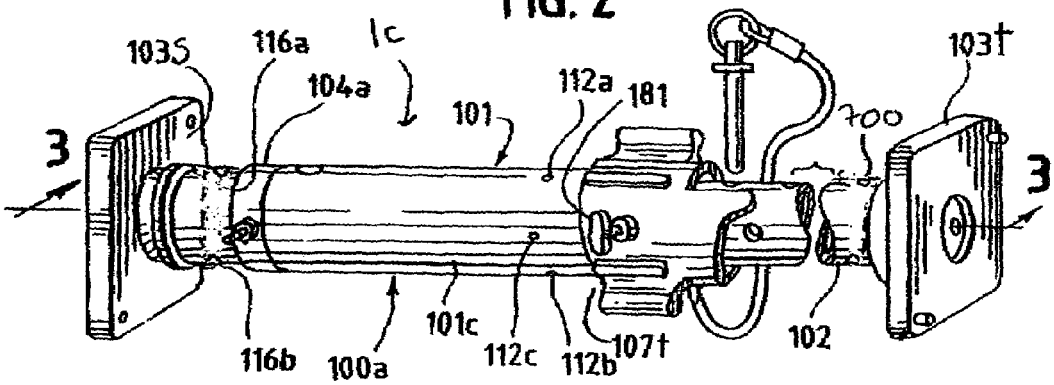
FIG. 2: Longitudinal prospective view of the pin and collar shoring device comprising removable swivel side plates with détente sphere attachments.
Figures 3, 4, 5, 6:
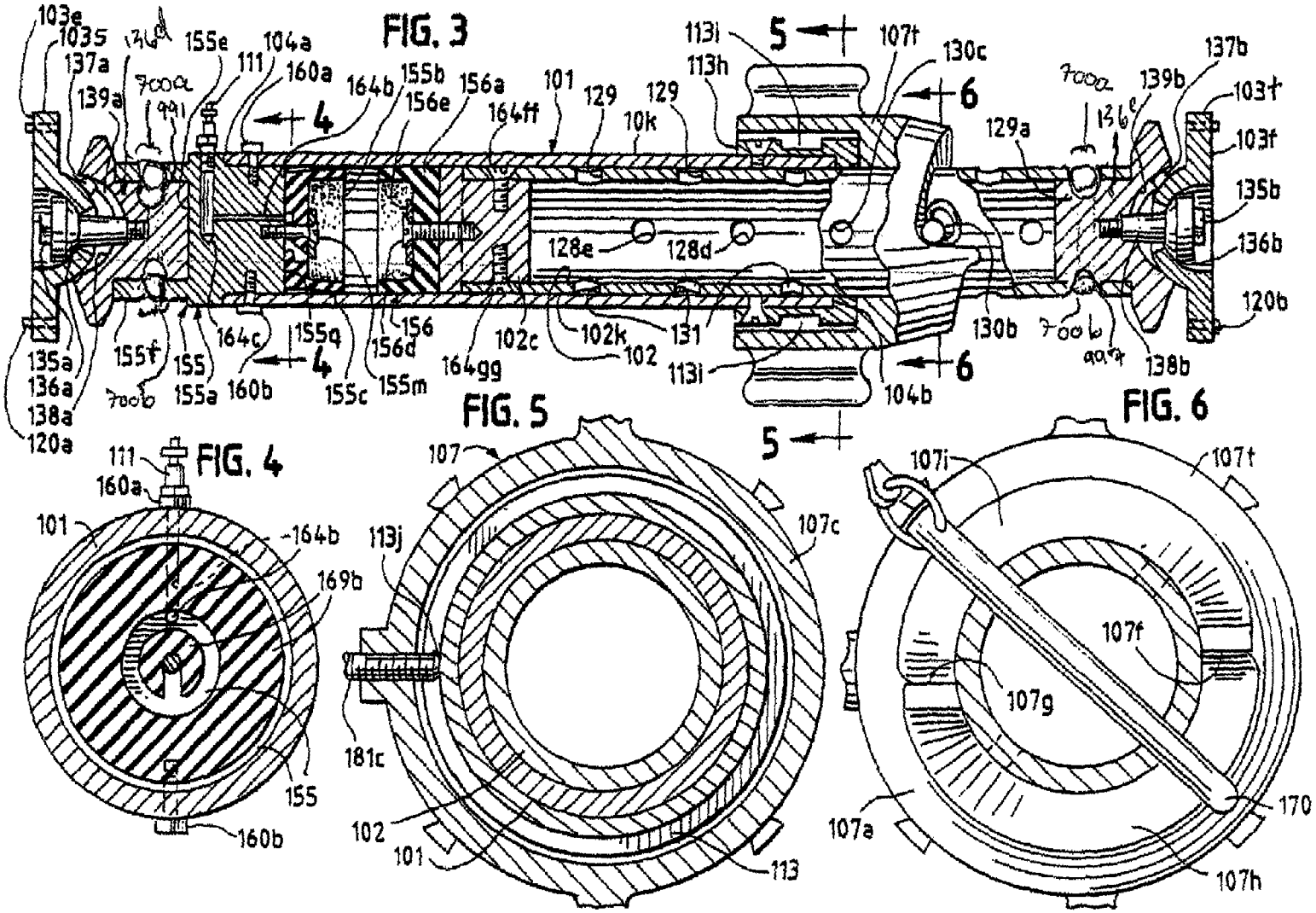
FIG. 3: Partial transverse longitudinal view of shoring device through view line 3-3 of FIG. 2.
FIG. 4: Cross-sectional view of FIG. 3 taken through view line 4-4.
FIG. 5: Cross-sectional view of FIG. 3 taken through view line 5-5.
FIG. 6: Cross-sectional view of FIG. 3 taken through view line 6-6.

Referring initially to FIGS. 2 and 3, the preferred embodiment of the pin and collar shoring prototype 1*c* comprises a piston 102, cylinder 101, outer collar 107*t* with threaded pin 181, and first and second removable swivel side plates 103*s*, 103*t*. Each removable swivel side plate 103*s*, 103*t* preferably contains opposing first and second détente sphere attachments 700*a*, 700*b* respectively [generically détente sphere attachments 700]. However, removable swivel side plates with only one dente sphere attachment 700 are also within the scope of the invention.

Each first détente sphere attachment 700*a* within a removal swivel side plate 103*s*, 103*t* opposes second attachment 700*b* at approximately 180 degrees. These features are identical for outer ratcheting collar shoring device prototype 1*d*.

Pin and collar shoring device 1*c* is particularly suited for shoring of trench walls, by using compressed gas to laterally extend piston 102, as is outer ratcheting collar shoring device prototype 1*d*. However, other sources of appropriate lateral force are also within the scope of my invention. My shoring devices 1*c*, 1*d* are both preferably approximately 43 inches long in its maximum extended configuration, and approximately 33 inches in its most retracted configuration.

Three other satisfactory lengths for both prototypes 1*c*, 1*d* are as follows:

(1) approximately 25 inches when fully retracted and approximately 30 inches when fully extended;

(2) approximately 45 inches when fully retracted position and approximately 65 inches when fully extended; and (3) approximately 67 inches when fully retracted and approximately 102 inches when fully extended.

However, other diameters and lengths are also within the scope of my invention. Circular rubber endcups 155*b*, 156 infra, add approximately two inches to every model, so that only cylinder and piston length varies.

Cylinder 101, Swivel Removable Proximal Cylinder Side Plate 103*s*, Swivel Removable Distal Piston Side Plate 103*t*; First and Second Détente Sphere Attachments 700*a*, 700*b*

Still referring to FIGS. 2 and 3 of the preferred embodiment of the pin and collar prototype, shoring device prototype 1*c* comprises cylinder 101. Cylinder 101 is preferably approximately 15 inches in length and approximately 3.0 inches in interior diameter for both prototypes 1*c* and 1*d*. Cylinder wall 101*c* is preferably approximately one-quarter of an inch (¼") thick. Cylinder 101 has a proximal cylinder end 104*a* and distal cylinder end 104*b*. These measurements are also preferred for outer ratcheting collar shoring device prototype 1*d*.

Cylinder 101 contains a removable swivel proximal cylinder side plate 103*s* whenever shoring device prototype 1*c* or 1*d* is fully assembled. Removable swivel proximal cylinder side plate 103*s* is identical in structure, size and function to removable swivel distal piston side plate 103*t*, infra. Each removable swivel side plate 103*s*, 103*t* respectively comprises a plate 103*e*, 103*f* respectively, and each plate 103*e*, 103*f* is preferably approximately five inches in length and width. Still referring to FIGS. 3 and 7, each removable swivel side plate 103*s*, 103*t* also comprises a central screw 135*a*, 135*b* respectively within first and second cylindrical interior segments 136*d*, 136*e* respectively.

Figure 1:
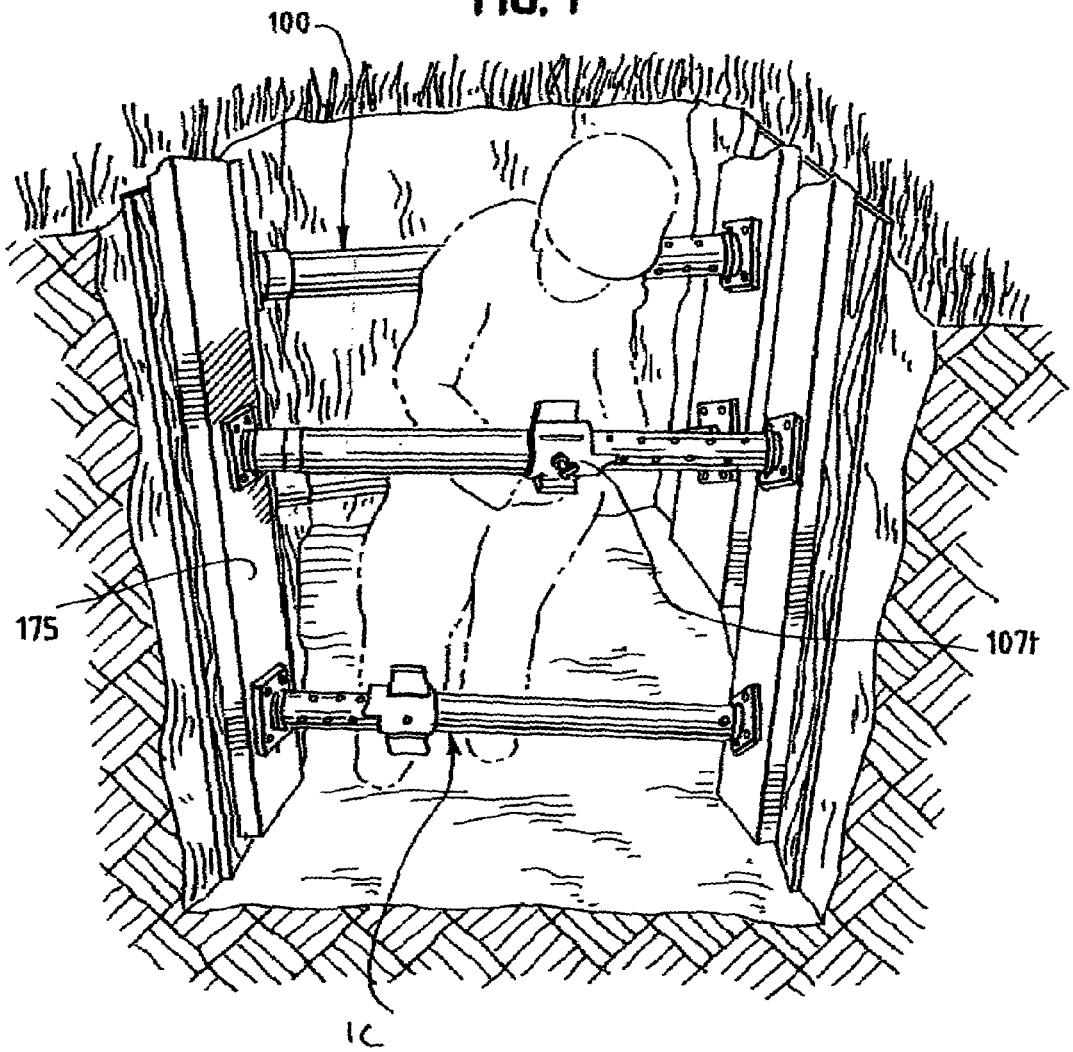
FIG. 1: View of an operator installing a plurality of pin and collar shoring devices within a trench.

Swivel removable cylinder proximal side plate 103*s* and removable swivel piston distal side plate 103*t* each comprise at least one adjustable first and second set screw 120*a*, 120*b* respectively, for engagement with wood shoring boards and/or aluminum wale-plates 175 (FIG. 1). When prototype 1*c*, 1*d* is fully assembled, first and second cylinder end apertures 116*a*, 116*b* are approximately one and ¾ inches from cylinder proximal end 104*a*. Cylinder end apertures 116*a*, 116*b* can congruently align with détente sphere attachments 700*a*, 700*b*, infra.

Figure 7:
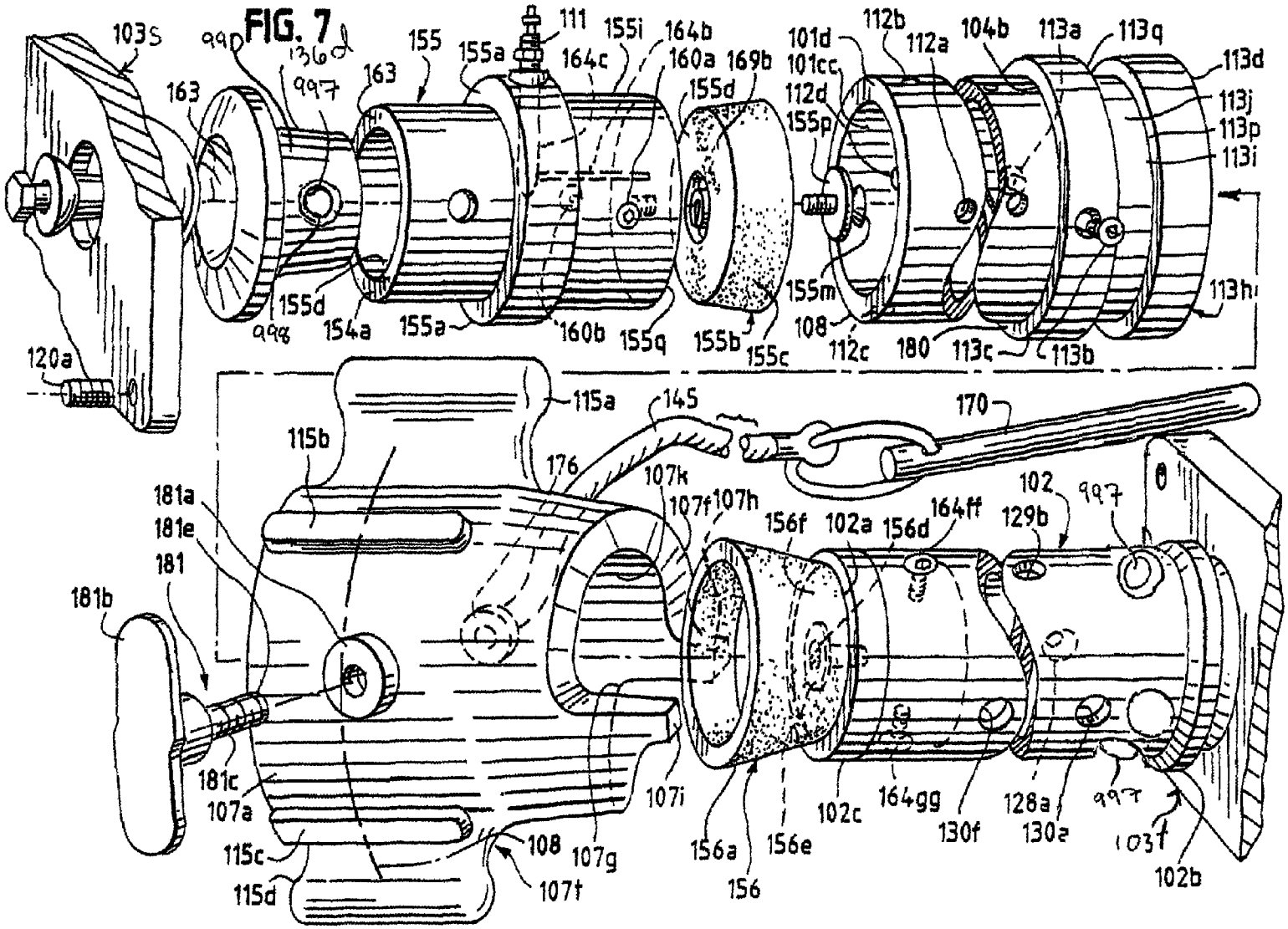
FIG. 7: Exploded view of pin and collar shoring device with removable swivel side plates containing détente sphere attachments.

Referring to FIGS. 3 and 7, each central segment 136*a*, 136*b* respectively comprises a first and second swivel groove 137*a*, 137*b* respectively. First and second inserting portions 138*a*, 138*b* respectively attach within grooves 137*a*, 137*b* respectively, by first and second inserting ridges 139*a*, 139*b* respectively.

Each groove 137*a*, 137*b* containing an inserting ridge 139*a*, 139*b* respectively prevents a removable swivel proximal cylinder side plate 103*s* or removable swivel distal piston side plate 103*t*, from swiveling in an unlimited manner in both prototypes 1*c*, 1*d*. However, other side plates, base plates or attachments are also within the scope of my invention.

Figure 12:
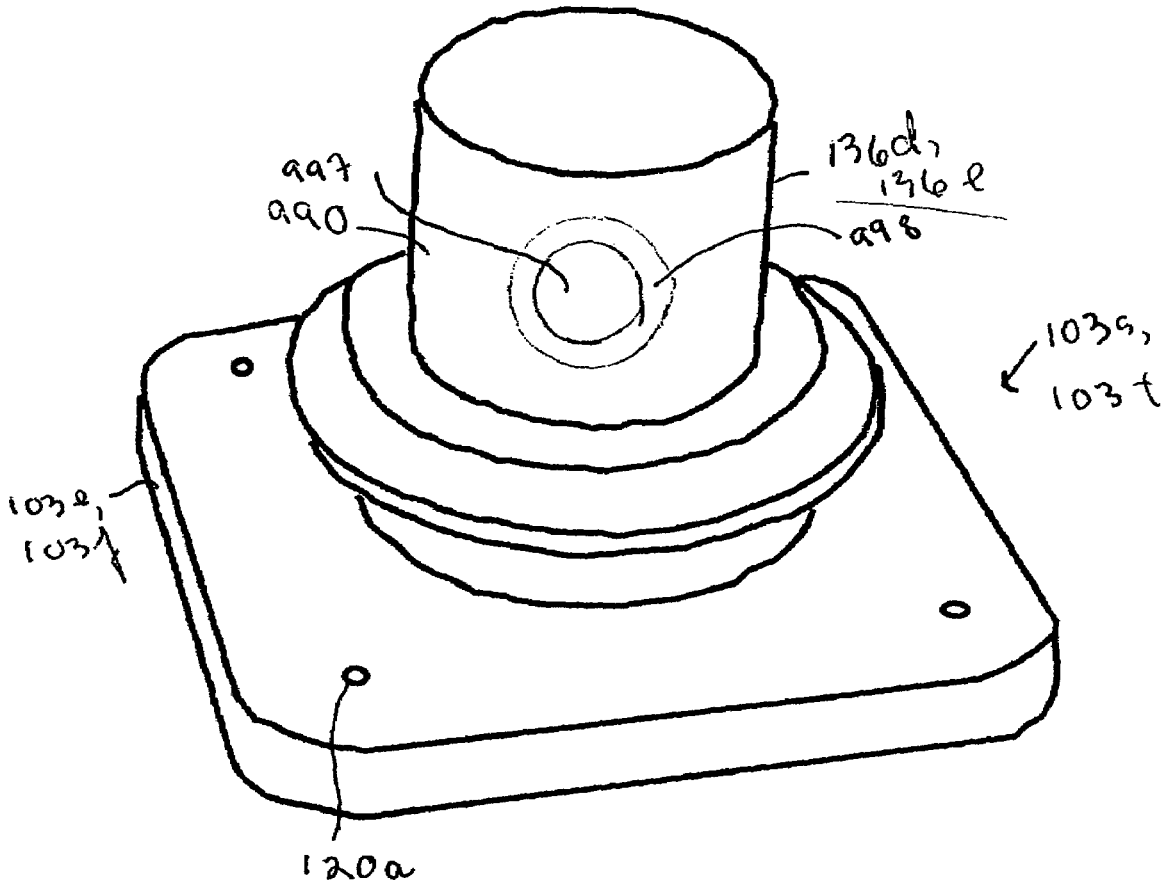
FIG. 12: Partial anterior perspective view of an isolated removal swivel side plate with detente sphere attachment.

Referring now to FIG. 12 for both prototypes 1*c*, 1*d*, within exterior wall surface 990, each removable cylinder proximal swivel side plate 103*s* preferably contains opposing first and second détente sphere attachments 700*a*, 700*b* (as does removable piston distal swivel side plate 103*t*) within the exterior wall surface 990 of each cylindrical interior segment 136*d*, 136*e*. Each detente sphere attachment 700*a*, 700*b* comprises a corresponding first or second circular depression 992*a*, 992*b* respectively. In other embodiments, each removable swivel side plate 103*s* or 103*t* contains only one detente sphere attachment 700*a*.

Figure 13A:
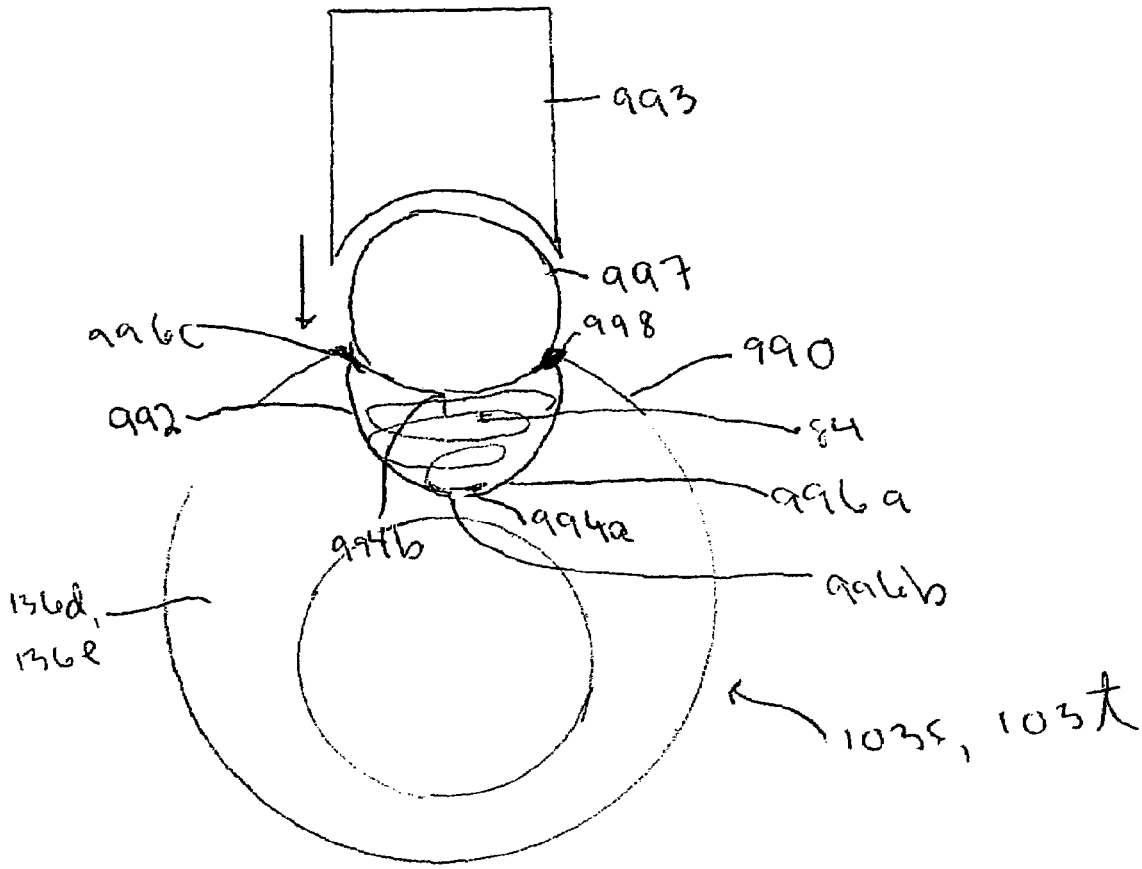
FIG. 13A: Closeup isolated cross-sectional view of a detente sphere attachment within an interior cylindrical segment.
Figure 13B:
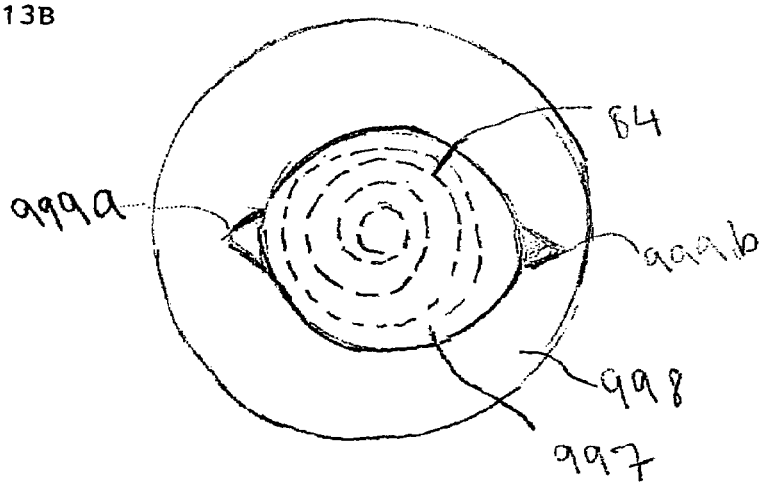
FIG. 13B: Isolated closeup top plan view of détente sphere attachment.
Figure 13C:
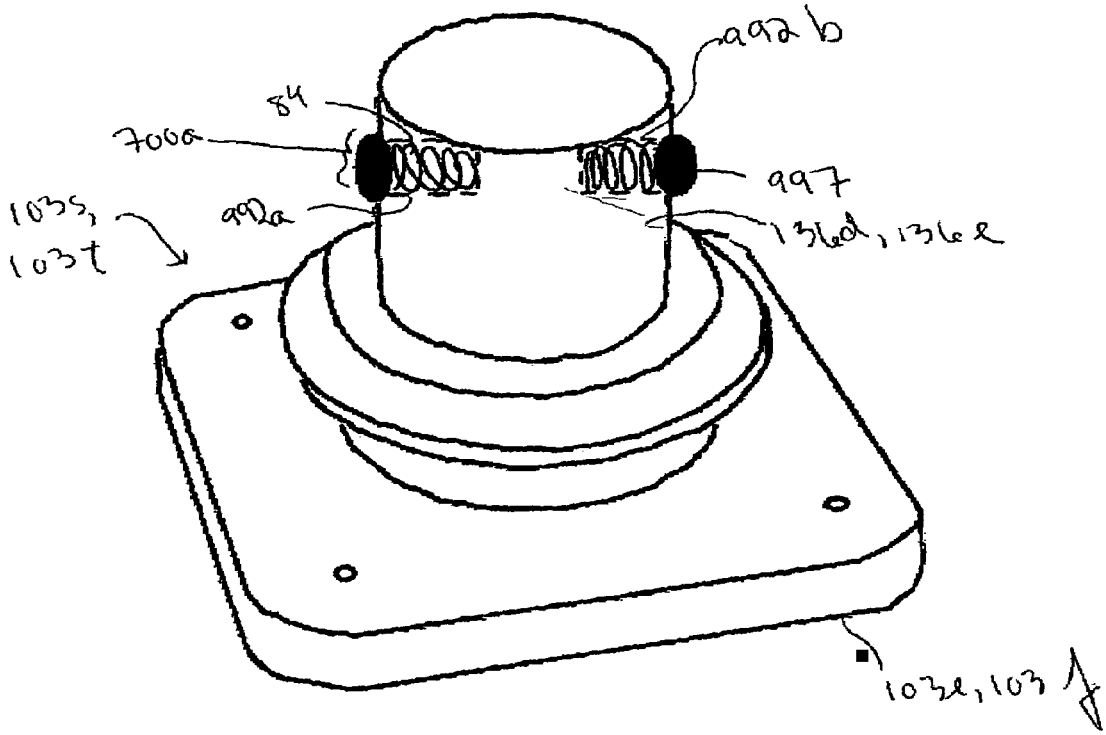
FIG. 13C: Partial anterior closeup view of removable swivel attachment plate with opposing détente sphere attachments.

Referring to FIGS. 13*a*, 13B, and 13C, first and second circular depressions 992*a*, 992*b* [generically circular depressions 992] oppose each other at approximately 180 degrees along the corresponding removable swivel side plate 103*s*, 103*t* (for either prototype 1*c* or 1*d*). Each circular depression 992 comprises depression circular wall 996*a*, circular depression floor 996*b*, and circular depression upper edge 996*c*. Each circular depression 992*a*, 992*b*, has a maximum depth of approximately one-half inch and a maximum diameter of approximately ⅝ inch. Each circular depression 992*a*, 992*b* also comprise opposing notches 999*a*, 999*b* within circular depression upper edge 996*c*. Opposing notches 999*a*, 999*b*, prevent separation of a lodged détente sphere 997 from circular depression 992*a*, 992*b*.

Still referring to FIGS. 13A, 13B and 13C within each opposing circular depression 992*a*, 992*b* is single small spring 84. Each single small spring 84 is preferably made of stainless steel. Single small spring 84 is approximately ½ inch in height and ⁄5;8 inch in coil diameter when spring 84 is neither stretched nor compressed. Single small spring 84 is positioned vertically with first spring end 994*a* lodged rightly against depression floor 996*b*.

Immediately above single small spring 84 is single détente sphere 997, and which second small spring end 994*b* continually contacts. Both single small spring 84 and detente sphere 997 are preferably made of stainless steel. Détente sphere 997 is spherical in three-dimensions and is approximately five/eighths inch in diameter. Each détente sphere 997 is sized to protrude within piston apertures 131/129, 128/130 infra, and cylinder apertures 116*a*, 116*b* within removable swivel side plate 103*s* or 103*t*.

To produce détente sphere attachment 700*a*, 700*b*, in the best mode the operator uses a ⅝ inch drill bit to drill circular depression 992*a*. 992*b* to a maximum depth of approximately one-half inch within exterior wall surface 990 (both prototypes 1*c* or 1*d*). Circular depression 992 is preferably approximately one-half inch in depth and approximately ⅝ inch in diameter. Stainless steel single small spring 84 is then inserted and lodged within its corresponding circular depression 992*a*, 992*b*.

Next the operator lodges a suitably sized stainless détente sphere 997 upon upper circular edge 998. He or she then strikes detente sphere 997 with either a hammer or punch press 993. Referring to FIG. 13A, opposite spring end 995 now snugly contacts détente sphere 997. Hammer or punch press 993 also creates continuous bevel 998 which encloses circular depression 992.

When manually depressed, detente sphere 997 retracts into its corresponding circular depression 992, thereby placing tension (and creating potential energy) within contacting single small spring 84. When the operator decompresses détente sphere 997, the energy/tension within single small spring 84 is released. Single small spring 84 now presses against détente sphere 997, thereby causing détente sphere 997 to protrude from circular depression 992.

Removable swivel proximal cylinder side plate 103*s* connects to cylinder 101 by: (i) inserting swivel side proximal cylinder plate 103*s* into cylinder 101 while depressing détente sphere 997; and (ii) aligning first and second circular depressions 992*a*, 992*b* respectively with cylinder end apertures 116*a*, 116*b*; and (iii) releasing pressure upon détente spheres 997. Now congruently aligned détente spheres 997*a*, 997*b* protrude from corresponding opposing circular depressions 992*a*, 992*b*, and into cylinder end apertures 116*a*, 116*b* respectively. This protrusion physically prevents separation of removable swivel proximal cylinder side plate 103*s* (or removable swivel distal piston side plate lot as the case may be) from cylinder 101, until détente spheres 997 are again manually depressed.

First and second circular depressions 992*a*, 992*b* oppose each other at approximately 180 degrees in outer ratcheting collar prototype 1*d*, as well pin and collar prototype 1*c*. In all respects, outer ratcheting collar prototype 1*d* with détente sphere attachments 700*a*, 700*b* comprise the same structure, method of production and method of attachment as that of prototype 1*c*.

Referring now to FIGS. 3 and 7 of the preferred embodiment of prototype 1*c* approximately three inches from inserted proximal removable swivel cylinder side plate 103*s*, and approximately 90 degrees from circular depressions 992*a*, 992*b*, is compressed gas inlet 111. Compressed gas inlet 111 connects shoring device 1 to an external source of compressed gas through cylindrical plug 155, infra.

As seen in FIGS. 3 and 7, small circular vents 112*a*, 112*b*, 112*c*, 112*d* (generically small circular vents 112) for gas exhaust are aligned along a cylinder circumference at intervals of approximately 90 degrees to each other. Small circular vents 112 are approximately one quarter inch in diameter. In the preferred embodiment there are four small circular vents 112, but other numbers are also satisfactory. These same features are present in prototype 1*d*.

Proximal cylinder plug 155 of Pin and Collar Prototype 1*c* and Outer Ratcheting Collar Prototype 1*d*

Referring to FIGS. 3 and 7, cylinder plug 155 is part of cylinder 101, and cylinder plug 155 is contiguously attached to cylinder 101 by first and second set screws 160*a*, 160*b* respectively. First and second set screws 160*a*, 160*b* oppose each other at approximately 180 degrees along cylinder 101. Cylinder plug 155 abuts proximal cylinder end 104*a* by circular contiguous ledge 155*a*. Metal contiguous ledge 155*a* is also the cylindrical component into which compressed gas inlet 111 inserts. Proximal cylinder swivel removable side plate 103*s* inserts into cylinder plug 155 proximal to circular contiguous ledge 155*a*.

Still referring to FIGS. 3 and 7, the inner diameter of cylinder plug 155 is approximately 3.5 inches. Cylinder plug wall 155*f* is preferably approximately ⅔ (two-thirds) inch in thickness at proximal plug end 154*a*. Cylinder plug interior 155*d* comprises a proximal round metal barrier 155*e* which abuts fully inserted swivel proximal cylinder removable swivel side plate 103*s*.

Still referring to FIGS. 3 and 7, cylinder plug 155 at distal plug end 155*q* comprises cylindrical endcup 155*b*. Cylindrical endcup 155*b* comprises an outer raised circular rim 155*c*, which faces a piston rubber endcup 156, infra, within a fully assembled shoring device 100. Cylindrical endcup 155*b* comprises the same shape, dimensions and material as piston rubber endcup 156, infra. Cylindrical endcup 155*b* abuts piston rubber endcup 156 by raised circular rim 155*c*, whenever piston 102 is completely inserted within cylinder 101. Cylindrical endcup 155*b* also comprises a cylindrical endcup floor 155*d* with centrally located bolt aperture 155*j*. Plug bolt 155*m* inserts into bolt aperture 155*j* and thereby attaches distal plug end 155*q* to cylinder endcup 155*b*. Cylinder washer 155*p* surrounds plug bolt 155*m*.

Figure 8:
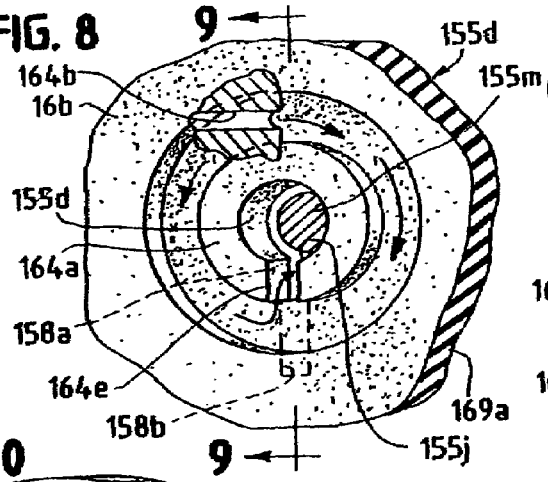
FIG. 8: Isolated view of lower floor surface of cylinder endcup in both pin and collar and outer ratcheting collar shoring devices.
Figure 9:
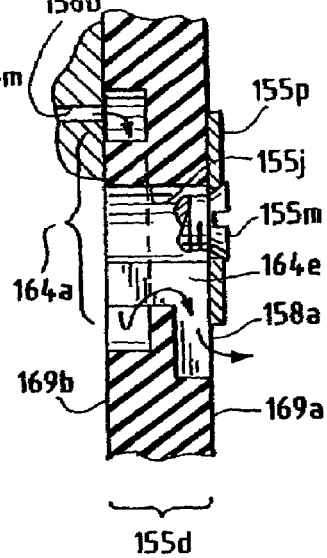
FIG. 9: Closeup cross-sectional view of FIG. 8 taken through view line 9-9.

Referring to FIGS. 8 and 9, cylindrical endcup floor 155*d* comprises an upper endcup floor surface 169*a* and a lower endcup floor surface 169*b*. Also referring to FIG. 10 of the preferred embodiment, cylinder endcup 155*b* comprises a lower air aperture 158*b* within its lower endcup floor surface 169*b*, and upper air aperture 158*a* within upper endcup floor surface 169*a*. Lower and upper air apertures 158*a*, 158*b* respectively are integrally connected to each other by (i) a first air channel segment 164*a* within rubber endcup floor surface 169*b*; and (ii) a short air channel segment 164*e* traversing rubber cylinder endcup floor 155*d*.

Figure 10:
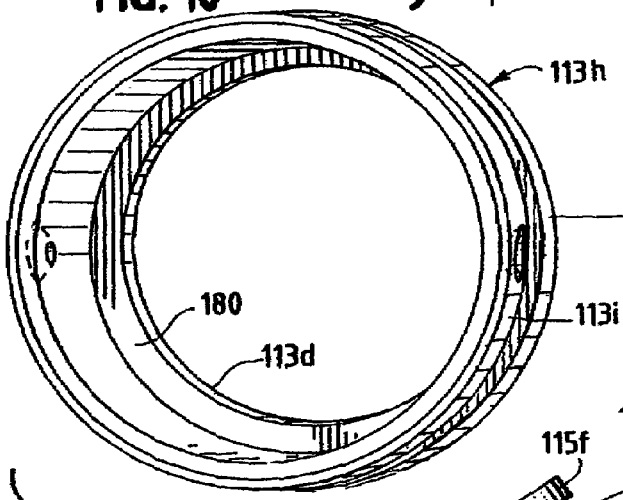
FIGS. 10 and 11: Partial anterior perspective view of an isolated inner ratcheting ring with cross-section view of the inner ring within an outer cam collar.

As best seen in FIGS. 4 and 9, first air channel segment 164*a* is circular, approximately one inch in exterior diameter and approximately one-quarter inch in depth along lower cylindrical endcup floor surface 169*b*. As best seen in FIG. 10, short air channel segment 164*e* is adjacent and parallel to bolt aperture 155*j* within endcup floor 155*d*. Short air channel 164*e* connects circular air channel segment 164*a* to upper aperture 158*a*. However, other embodiments of my invention need not comprise a first air channel segment 164*a* which is circular.

Referring to FIGS. 3 and 7, lower air aperture 158*a* is congruent and contiguous with second air channel segment 164*b* within cylinder plug 155. Air channel segment 164*b* is adjacent to and parallel to longitudinal midline 163 of cylindrical plug 155, as seen in FIG. 4. In the preferred embodiment, second air channel segment 164*b* is continuously connected to third air channel segment 164*c*. Third air channel segment 164*c* is approximately perpendicular to second air channel segment 164*b*. Preferably both air channel segments 164*b* and 164*c* are linear in form.

Second air channel segment 164*b* leads towards the outer metal surface of cylinder plug 155, and is continuous with gas inlet 111. Gas inlet 111 is continuously connected to an external source of pressurized gas, such as CO2 or air. Consequently when air is introduced from an exterior source, there is a continuous pressurized gas channel through: gas inlet 111; third and second air channel segments 164*c*, 164*b*; lower air aperture 158*b*; circular first air channel segment 164*a*, short air channel segment 164*e*; and finally upper air aperture 158*a*.

After passing through this previously described pathway, within seconds this pressurized air seals piston endcup raised circular rim 156*a* against inner cylinder wall 101*cc*. FIG. 4 illustrates the physical continuity of lower aperture 158*a* in rubber endcup 155*b*, with metal distal cylindrical plug end 155*q*, with respect to bolt aperture 155*j* and adjacent second air channel segment 164*b*.

All the above features of the endcup are identical for prototypes 1*c* and 1*d*.

Piston 102 of Prototypes 1*c*, 1*d*

Referring initially to FIGS. 2, 3 and 7 of the preferred embodiment of pin and collar prototype 1*c*, piston 102 is cylindrical, approximately thirteen (13) inches in length, and approximately two and one-quarter inches in inner diameter. However, other lengths and diameters are also within the scope of my invention. Piston 102 comprises a piston wall 102*k*, which is approximately ¼-inch (one-quarter) inch in thickness. Piston 102 is narrower in diameter than cylinder 101, into which piston 102 reversibly inserts. These same features are all included within, and identical with, prototype 1*d*.

Along its longitudinal axis piston 102 comprises four linearly aligned parallel sets of piston apertures 128*a*, 128*b*, 128*c*, 128*d*; 128*e*; 129*a*, 129*b*, 129*c*, 129*d*, 129*e*, 129*f*; 130*a*, 130*b*, 130*c*, 130*d*, 130*e*; and 131*a*, 131*b*, 131*c*, 131*d*, 131*e*, 131*f* (generically opposing piston apertures 128, 129, 130, 131). Representative apertures 128, 129, 130, 131 are best seen in FIGS. 3 and 7, and are preferably approximately 1 and ½ inches in diameter. Outer ratcheting collar prototype 1*d* has these same preferred identical structure and features as pin and collar prototype 1*c*.

Each set of piston apertures 128, 129, 130, 131 is preferably approximately 90 degrees from each adjacent aligned set. However, individual adjacent apertures are preferably aligned at the midpoint of adjacent apertures, as best seen in FIG. 3. Opposing sets 128/130 and 129/131 are approximately 180 degrees from each other, so that straight metal camming pin 170 is inserted through them simultaneously, as best seen in FIG. 7.

Four linearly aligned sets are preferred, but other numbers of linearly aligned sets are also within the scope of my invention. There are also preferably two opposing sets of five apertures per linearly aligned set (128/130), and two opposing sets of six apertures (129/131) per linearly aligned set. However, other numbers of piston apertures are also within the scope of my invention, and both prototypes 1*c*, 1*d* comprise these identical features.

Still referring to FIGS. 3 and 7, in a fully assembled shoring device 1*c* or 1*d*, piston 102 is closed at most distal end 102*b* by removable swivel piston distal side plate 103*t*. Removable swivel piston distal side plate 103*t* is attached within piston 102 by détente sphere attachments 700*a*, 700*b* through:

(i) piston apertures 128/130 or 129/131; and (ii) first and second swivel piston distal side plate apertures 141*a*, 141*b* respectively. In this attaching process, piston apertures 128/130 or 129/131 congruently align with piston distal side plate apertures 141*a*, 141*b* for protrusion of corresponding detente spheres 997.

Still referring to FIGS. 3 and 7, at its proximal end 102*a* piston 102 is capped by metal piston endwall 102*c*. Metal piston endwall 102*c* is secured to piston 102 by first and second opposing screws 164*ff*, 164*gg* respectively. Metal piston endwall 102*c* is flush with piston wall 102*k*, and is approximately one-half inch in thickness at its proximal end.

Piston rubber endcup 156 is secured to metal piston endwall 102*c* by piston bolt 156*d* extending through metal washer 156*e*. In the center of piston rubber endcup flat circular floor 156*f* (which is preferably approximately three inches in diameter) is piston bolt 156*d*. In other embodiments, piston endcup 156 comprises identical apertures 158 and channel segments 164 to cylinder endcup 155*b*. In fact if endcups 155*b*, 156 are mass produced, this would be the most economical approach. However, in these embodiments apertures and channels in endcup 156 are covered with a large washer because they have no function in piston endcup 156. In the preferred embodiment, piston endcup 156 comprises no air apertures or air channel segments of any type. Please see FIGS. 3 and 7.

Circular piston rubber endcup 156 comprises raised circular rim 156*a*, and raised circular rim 156*a* is preferably approximately one inch in height. Circular piston rubber endcup 156 immediately flares, and thereby air seals circular raised rim 156*a* whenever compressed gas enters inlet 111 and flows through air channel segments 164 and air apertures 158*a*, 159*b*. This air seal is caused by compression of raised circular rim 156*a* against interior cylindrical wall surface 101*cc* by pressurized gas.

All the above described features are identical in structure and functions within prototypes 1*c* and 1*d*.

Inner Ratcheting Ring 113 of Prototype 1*d*

Figures 14, 15A:
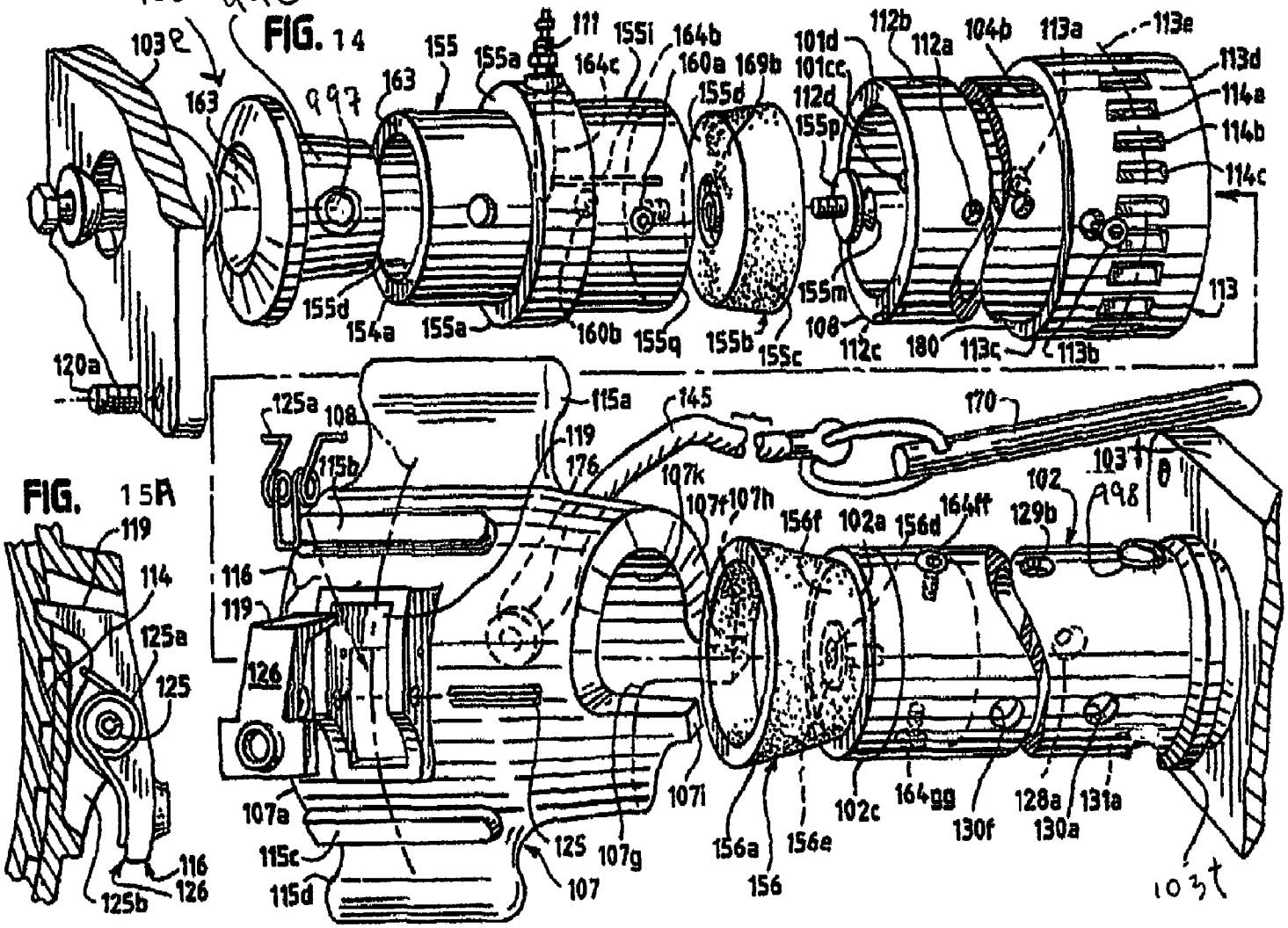
FIG. 14: Exploded view of outer ratcheting collar prototype of shoring device with detente sphere attachments.
FIG. 15A: Lateral isolated view of locking member engaged within a serration in outer ratcheting collar prototype.
Figure 15:
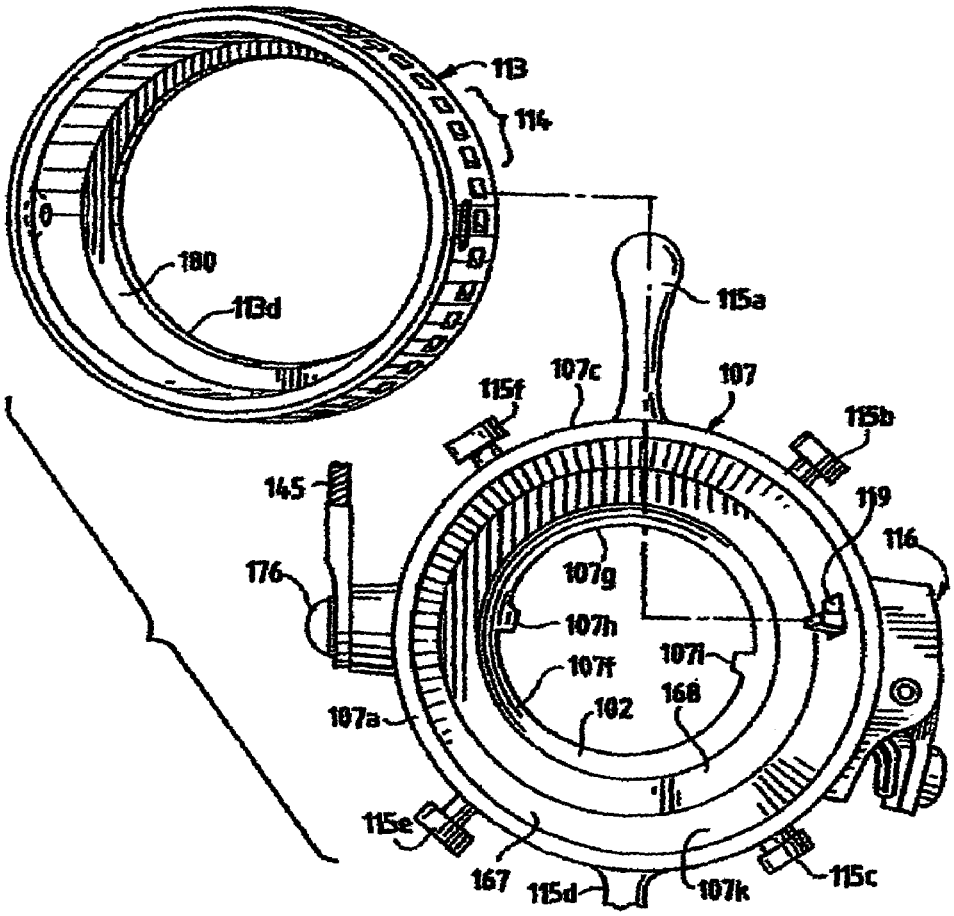
FIG. 15B: Isolated view of inner ratcheting ring with cross-sectional view of inner ratcheting ring enclosed by an outer ratcheting collar.
Figures 18, 19, 20, 21:
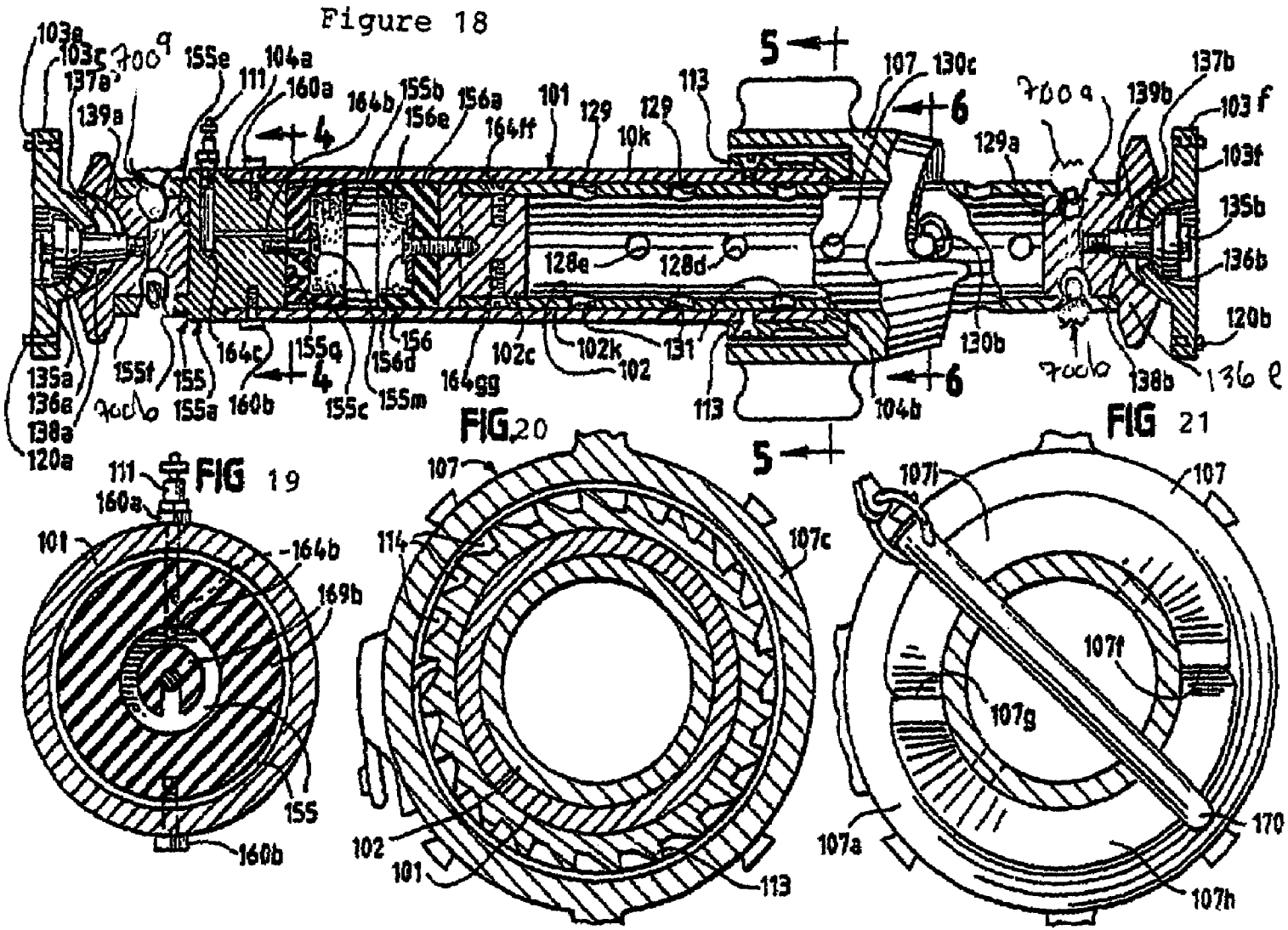
FIG. 18: Transverse longitudinal view of outer ratcheting collar prototype with détente sphere attachments.
FIG. 19: Cross-sectional view of FIG. 18 through view line 4-4.
FIG. 20: Cross-sectional view of FIG. 18 through view line 5-5.
FIG. 21: Cross-section view of FIG. 18 through view line 6-6.

Referring initially to FIGS. 14 and 18, inner ratcheting ring 113 encloses distal cylinder end 104*b* in fully assembled outer ratcheting collar shoring device 1*d*. Inner ratcheting ring 113 attaches to cylinder 101 by first serration set screw 113*a* and second serration set screw 113*b*. Serration set screws 113*a*, 113*b* oppose each other at approximately 180 degrees along cylinder 101. Inner ratcheting ring 113 is preferably approximately three inches in width parallel to the long axis of cylinder 101, and approximately twelve and one-half inches in outer circumference. Inner ratcheting ring 113 has a proximal ring edge 113*c* and a distal ring edge 113*d*, both of which are beveled.

Referring now to FIG. 15B, inner ratcheting ring 113 is preferably approximately ¼ inch in thickness at distal ring edge 113*d* and proximal ring edge 113*c*. Inner ratcheting ring 113 also comprises a circular metal lip 180 at beveled distal ring edge 113*d*. Circular metal lip 180 is continuous with beveled distal ring edge 113*d*, and lip 180 is approximately perpendicular thereto. Circular metal lip 180 fits over cylinder distal end 104*b* and prevents inner ratcheting ring 113 from sliding along cylinder 101 (in addition to opposing serration set screws 113*a*, 113*b*).

Circular metal lip 180 is approximately one-half inch wide, approximately one-half inch in thickness, and approximately three inches in inner diameter in the preferred embodiment. However, other dimensions of circular metal lip 180 are within the scope of my invention.

Referring to FIGS. 14, 15A and 20 of the preferred embodiment, along the approximate midline circumference 113*e* of inner ratcheting ring 113 are a plurality of linearly aligned serrations 114*a*, 114*b*, 114*c*, etc. (generically serrations 114). When seen in upper plan view (FIG. 16), the edges of serrations 114 preferably form four-sided polygons. Preferably, each serration 114 in upper plan view comprises an upper longitudinal side 161*a* and a lower longitudinal side 161*b*. Longitudinal sides 161*a*, 161*b* of a single serration 114 are approximately parallel to the two longitudinal sides 161*a*, 161*b* of each adjoining serration 114. Longitudinal sides 161*a*, 161*b* of each serration 114 are aligned approximately perpendicular to midline circumference 113*e*, as best seen in FIG. 14.

Figure 16:
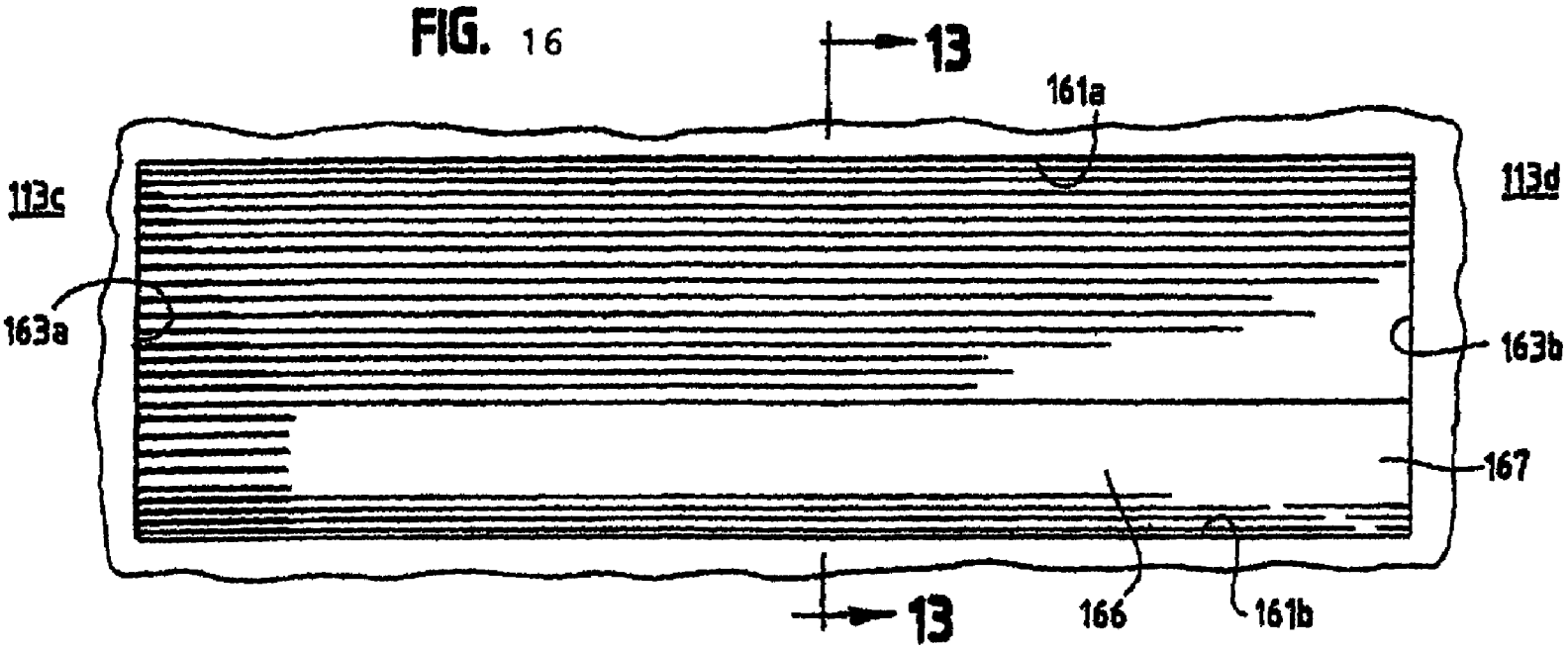
FIG. 16: Isolated upper plan view of a single serration within an inner ratcheting ring.
Figure 17:
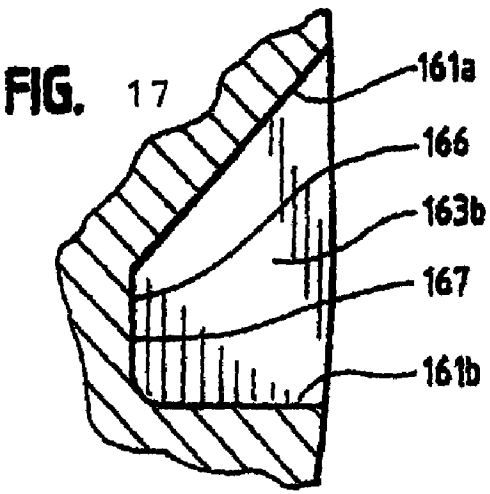
FIG. 17: Cross-section view of FIG. 16 taken through view line 13-13.

Referring to FIGS. 16 and 17, each serration 114 has a shorter proximal width side 163*a* and a distal width side 163*b*. Each width side 163*a*, 163*b* is approximately parallel to midline circumference 113*e*, and each width side 163*a*, 163*b* is shorter than either longitudinal length 161*a*, 161*b*. Each upper longitudinal side 161*a* of each serration 114 diverges toward distal serrated ring edge 113*d* approximately ten degrees.

Also seen in FIGS. 16 and 17 is narrow longitudinal base 166 of each serration 114. As best seen in FIG. 17 in cross-sectional view, each narrow longitudinal base 166 slopes from upper longitudinal side 161*a* to a maximum longitudinal depth 167. Each maximum longitudinal depth 167 is perpendicular to midline circumference 113*e*.

Still referring to FIGS. 16 and 17, maximum longitudinal depth 167 is positioned more proximal to lower longitudinal side 161*b*. In the preferred embodiment, each serration 114 is approximately:

(i) One-quarter inch in maximum longitudinal depth 167;

(ii) One-quarter inch wide at distal width end 163*a*; and (iii) ⅞ inch in length along upper longitudinal side 161*a*, and ¾ inch along lower longitudinal side 161*b*.

Each maximum longitudinal depth 167 is also approximately parallel to each maximum longitudinal depth 167 of adjoining serrations 114. Each serration 114 is separated from adjoining serrations 114 by approximately three-eighths (⅜) inch at each proximal width side 163*a*, and approximately one-eighth (⅛) inch at distal width side 163*b*. In the preferred embodiment there are 37 (thirty-seven) rectangular serrations along midline circumference 113*e*. However, other numbers, sizes and shapes, and depths of serrations are also within the scope of my invention.

Outer Ratcheting Collar 107 of Outer Ratcheting Collar Prototype 1*d*

Referring initially to FIGS. 14 and 18 of the preferred embodiment, outer ratcheting collar 107 can move axially from piston distal end 102*b* to cylinder distal end 104*b*. After assembly outer ratcheting collar 107 completely encloses inner ratcheting ring 113.

Also referring to FIG. 15B, outer ratcheting collar wall 107*c* is preferably approximately one-quarter (¼) inch in thickness and approximately four and one-quarter (4 and ¼) inches at its greatest axial width. In the preferred embodiment, outer ratcheting collar 107 has an outer diameter of approximately 13 inches. Outer ratcheting collar 107 is approximately four inches wide at its narrowest outer width.

Still referring to FIGS. 14, 15B and 18, outer ratcheting collar 107 comprises a plurality of handles 115*a*, 115*b*, 115*c*, etc. (generically handles 115). Handles 115 are integral oblong components of outer ratcheting collar 107, and preferably are of two types:

(i) approximately four and one-quarter (4 and ¼) inches in axial and ⅓ (one third) inch in height (115*b* length (115*b*, 115*c*, 115*e*, 115*f*); and (ii) approximately four and one-quarter (4 and ¼) inches in length and one and three quarters (1 and ¾) inches in height (115*a*, 115*d*).

In the preferred embodiment, there are six handles; four of which are the shorter height handle 115. However, other heights, shapes, lengths, numbers and types of handles are also within the scope of my invention.

Referring to FIG. 14, handles 115 are aligned parallel to each other and approximately perpendicular to the midline circumference 108 of outer ratcheting collar 107. Preferably, approximately 3 and ½ inches separate adjoining handles 115*b*, 115*c*, while approximately 3 and ½ inches separate adjoining handles 115*e* and 115*f*. Outer ratcheting collar 107 also comprises a threaded vertical screw 176, by which metal camming pin 170 is tethered to outer ratcheting collar 107 by steel lanyard 145.

As best seen in FIGS. 14, 15B, 20 and 21 of the preferred embodiment, proximal outer ratcheting collar edge 107*a* is uniformly round and smooth. Proximal outer ratcheting collar edge 107*a* is preferably approximately one quarter (¼) inch in uniform thickness. Distal ratcheting collar edge 107*b* comprises 180 degree-opposing vertical first and second stopfaces 107*f*, 107*g* respectively. Continuous with stopfaces 107*f*, 107*g* are corresponding first and second sloping camming edges 107*h*, 107*i* respectively. Sloping camming edges 107*h*, 107*i* form camming surfaces for an abutting metal camming pin 170, infra.

Referring to FIGS. 14 and 15B of the preferred embodiment, outer ratcheting collar 107 comprises inner collar surface 107*k*. Inner collar surface 107*k* comprises wider circular proximal step 167 and narrow circular distal step 168. Each step 167, 168 is axially aligned along cylinder 101, so distal narrower step 168 is nearest distal piston end 102*b* in assembled shoring device 100. Wider proximal step 167 comprises a wider inner diameter. This wider diameter allows outer ratcheting collar 107 to slide over (i) piston 102, and then (ii) inner ratcheting ring 113 until circular metal lip 180 engages narrower distal step 168.

Wider circular proximal step 167 is approximately four inches in interior diameter and approximately preferably 2.8 inches in interior axial length. Circular distal narrower step 168 is preferably approximately three inches in interior diameter and approximately 2.5 inches in interior axial length. Without narrow circular distal step 168, outer ratcheting collar 107 could slide along cylinder 102 prior to adjustment with locking rectangular protrusion 119, infra As best seen in FIGS. 14 and 15A, between first and second short handles 115*b*, 115*c* respectively is collar lock member 116. Collar lock member 116 comprises a spring 125*a* biased rectangular protrusion 119, which completely penetrates outer ratcheting collar wall 107*c*. Rectangular protrusion 119 attaches to mechanical thumblock 126 by rotating hinge/roll pin 125. When there is no downward force on thumblock 126, rotating hinge 125 and spring 125*a* maintain rectangular protrusion 119 in an extended position from inner collar wall 107*k*. Rectangular projection 119 now interlocks with an appropriately positioned serration 114.

This engagement or interlocking can occur with each serration 114, but preferably only one at a time. This universal ratcheting effect occurs, because rectangular protrusion 119 is always congruently aligned over serrations 114 whenever outer ratcheting collar 107 is concentrically positioned over inner ratcheting ring 113. Please see FIGS. 15B and 20. To attain congruency, proximal edge of rectangular protrusion 119 is positioned approximately one inch and one-sixteenth (1 and 1/16) inch from proximal outer ratcheting collar edge 107*a*. Correspondingly, proximal width sides 163*a* of serrations 114 are approximately one and one-sixteenth (1 and 1/16) inches from proximal inner ratcheting ring edge 113*c*.

Interlocking of rectangular protrusion 119 and an appropriately positioned serration 114 immobilizes outer ratcheting collar 107 by mechanically attaching outer ratcheting collar 107 to inner ratcheting ring 113. With manual pressure upon mechanical thumblock 126, rectangular protrusion 119 retracts along rotating hinge/roll pin 125, and rectangular protrusion 119 disengages from interlocking serration 114. After disengagement, the operator can rotate outer ratcheting collar 107 or axially move it distally along piston 102. The operator must maintain manual pressure on mechanical thumblock 126 to rotate outer ratcheting collar 107 counterclockwise.

As seen in FIG. 8 of the preferred embodiment, there is only one properly positioned serration 114, which engages one single corresponding rectangular protrusion 117. One also sees sidewall 1255*b* of locking member 116 in section. In other embodiments of my shoring device 100 there can be more than one such interlocking serration 114 and more than one rectangular protrusion 119.

Outer Cam Collar 107*t* of Pin and Collar Prototype 1*c*

Referring initially to FIG. 2 of the preferred embodiment of prototype 1*c*, outer cam collar 107*t* can move axially from piston distal end 102*b* to cylinder distal end 104*b*. As seen in FIGS. 3 and 5 of the preferred embodiment, after assembly outer cam collar 107*t* completely encloses inner ring 113*h*.

Outer cam collar wall 107*c* is preferably approximately one-quarter (¼) inch in thickness and approximately four and one-quarter (4 and 1/4) inches at its greatest axial width. In the preferred embodiment, outer cam collar 107*t* has an outer diameter of approximately 13 inches. Outer cam collar 107*t* is approximately four inches wide at its narrowest outer width. However, other widths, diameters and thickness are also within the scope of my invention.

Referring now to FIG. 7 of the preferred embodiment, outer cam collar 107*t* comprises a plurality of handles 115*a*, 115*b*, 115*c*, etc. (generically handles 115). Handles 115 are integral oblong components of outer cam collar 107*t*, and preferably are of two types:

(i) approximately four and one-quarter (4 and ¼) inches in axial length and ⅓ (one third) inch in height (115*b* length (115*b*, 115*c*, 115*e*, 115*f*); and (ii) approximately four and one-quarter (4 and ¼) inches in length and one and three quarters (1 and ¾) inches in height (115*a*, 115*d*).

In the preferred embodiment, there are six handles; four of these six handles are the shorter height handle 115. However, other heights, shapes, lengths, numbers and types of handles are also within the scope of my invention. Referring to FIG. 7, handles 115 are aligned parallel to each other and approximately perpendicular to the midline circumference 108 of outer cam collar 107*t*. Preferably, approximately 3 and ½ inches separate adjoining handles 115*b*, 115*c*, while approximately 3 and ½ inches separate adjoining handles 115*e* and 115*f*. Outer cam collar 107*t* also comprises a threaded vertical screw 176, by which metal cam pin 170 is tethered to outer cam collar 107*t* by steel lanyard 145.

As best seen in FIG. 6 of the preferred embodiment, proximal outer cam collar edge 107*a* is uniformly round and smooth. Proximal outer cam collar edge 107*a* is preferably approximately one quarter (¼) inch in uniform thickness. As seen in FIG. 7, distal cam collar edge 107*b* comprises 180 degree-opposing vertical first and second stop faces 107*f*, 107*g* respectively. Continuous with stop faces 107*f*, 107*g* are corresponding first and second sloping cam edges 107*h*, 107*i* respectively. Sloping cam edges 107*h*, 107*i* form cam surfaces for abutting metal cam pin 170, infra.

Figure 11:
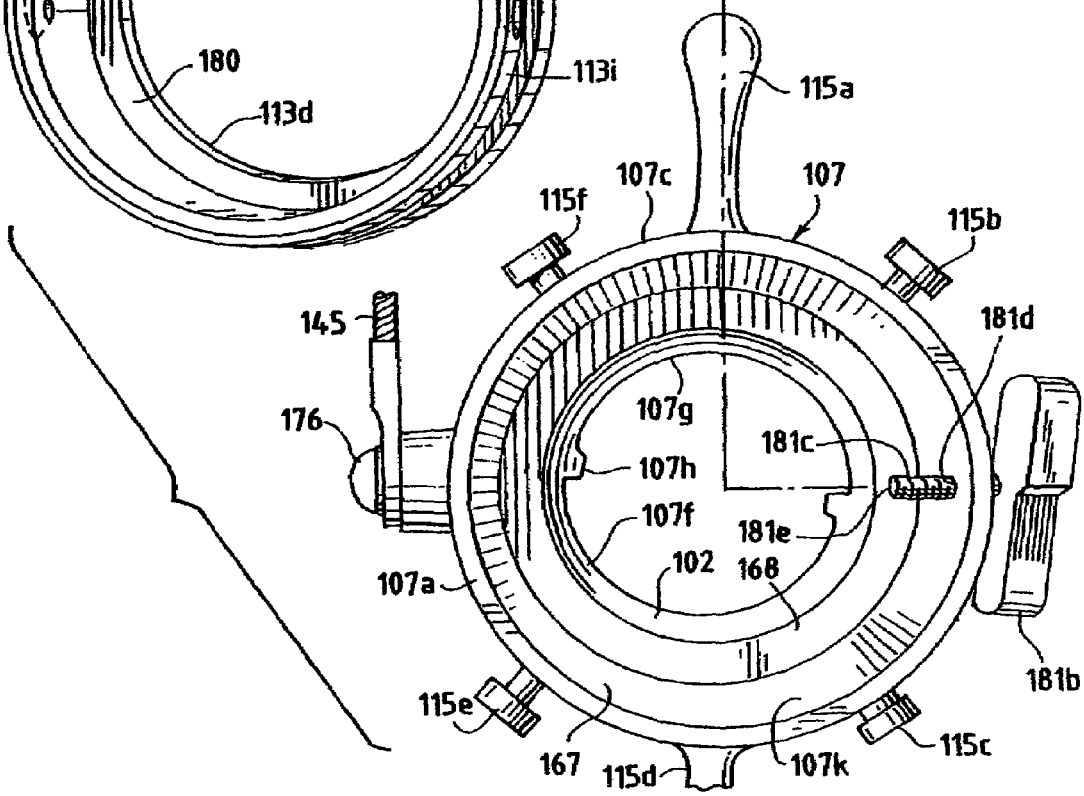

Referring to FIGS. 7 and 11 of the preferred embodiment, outer cam collar 107*t* comprises inner collar surface 107*k*. Inner collar surface 107*k* comprises wider circular proximal step 167 and narrow circular distal step 168. Each step 167, 168 is axially aligned along cylinder 101, so distal narrower step 168 is nearest distal piston end 102*b* in assembled shoring device 100*a*. Wider proximal step 167 comprises a wider inner diameter. This wider diameter allows outer cam collar 107*h* to slide over (i) piston 102, and then (ii) inner cam ring 113*h* until circular metal lip 180 engages narrower distal step 168.

Wider circular proximal step 167 is approximately four inches in interior diameter and approximately preferably 2.8 inches in interior axial length. Circular distal narrower step 168 is preferably approximately three inches in interior diameter and approximately 2.5 inches in interior axial length. Without narrow circular distal step 168, outer cam collar 107*t* slides along cylinder 102 prior to adjustment with threaded cam pin 185, infra.

As best seen in FIGS. 7 and 11, between first and second short handles 115*b*, 115*c* respectively is an abutting element which penetrates outer cam collar 107*t*. In the preferred embodiment, abutting element comprises a threaded pin 181 which is removable from an integral threaded boss 181*a*. Threaded pin 181 comprises a pin handle 181*b* which is approximately three and one-half inches in length. Threaded stem 181*c* inserts into threaded interior of handle 181*b* and is further attached with suitable solder. Integral threaded boss 181*a* is approximately one inch in diameter and one-half inch in height.

Threaded stem 181*c* is approximately one inch in length and approximately three-eighths inch in diameter at furthermost stem point 181*e*. Threaded stem 181*c* penetrates cam collar wall 107*c* through threaded boss 181*a* and threaded wall aperture 181*d*. When threaded stem 181*c* sufficiently protrudes through threaded wall aperture 181*d*, furthermost stem point 181*e* tightly abuts indentation floor 113*j* (whenever the operator manually turns threaded pin handle 181*d* as tightly clockwise as possible).

Other lengths and diameters of threaded pins 181 are also within the scope of my invention. To release threaded pin 181, the operator turns threaded pin handle 181*b* counter clockwise, so furthermost stem point 181*e* releases from indentation floor 113*j*. After release, the operator can rotate outer cam collar 107*t* or move it along piston 102. Because indentation floor 113*j* is continuous and smooth, threaded pin 181 can abut within the entire width and circumference of indentation floor 113*j*.

In addition my inner ring design enables the operator to loosen the threaded pin 181 from contact with indentation floor 113*j* while threaded in 181 remains within the continuous indentation walls 113*p*, 113*q*. This feature allows the outer cam collar 107*t* to rotate during transport or installation while eliminating inadvertent movement of outer cam collar 107.

Assembly of One Shoring Device Prototype 1*c* or 1*d*

Each shoring device prototype 1*c*, 1*d* is assembled exterior to a trench or structure to be shored or propped. The operator initially bolts rubber piston endcup 156 to proximal piston end 102*a*, while cylinder circular endcup 155*b* is bolted to distal end 1551 of cylinder plug 155. Cylinder plug 155 is then inserted into proximal end 104*a* of cylinder 101 and attached thereto with screws 160*a*, 160*b*. The operator then inserts piston 102 into distal end 104*b* of cylinder 101 until cylinder rubber endcup 155*b* abuts piston circular rubber endcup 156.

With prototype 1*d*, the operator now slides inner ratcheting ring 113 over cylinder 101 until circular metal lip 180 engages cylinder distal end 104*b*. The operator attaches inner-ratcheting ring 113 or inner ring 113*h* to cylinder 101 with two screws 113*a*, 113*b*. He or she then positions outer ratcheting collar 107 or outer cam collar 107*t* over inner ratcheting ring 113. During positioning of outer ratcheting collar 107, the operator manually depresses manual thumblock 126.

The operator now inserts removable swivel cylinder proximal endplate 103*s* into proximal cylinder end 104*a*, and inserts removable swivel distal piston endplate 103*t* into distal piston end 102*b*. The operator aligns first and second cylinder apertures 116*a*, 116*b* so they congruently match corresponding détente sphere attachments 700*a*, 700*b*. He then releases pressure from détente spheres 997 so each détente sphere 997 protrudes into corresponding apertures 116*a*, 116*b*.

In an identical manner, the operator releases pressure upon détente spheres 997 within removable swivel distal piston side plate 103*t*. Détente spheres 997 now protrude into congruently aligned opposing piston apertures 128/130 or 129/131, thereby forming a mechanical connection to piston 102. Tethered camming metal pin 170 is preferably temporarily inserted through an empty piston aperture, to prevent dragging and dangling outside the shoring area.

The assembly process is identical for prototype 1*c*, except that the outer cam collar 107*t* encloses inner ring 113*h*.

Operating Shoring Device Prototypes 1*c*, 1*d*

As an initial matter, prototypes 1*c*, 1*d* should never be operated except under lawful conditions and at the site of the shoring operation, infra. Assuming these safety conditions are met, either shoring device 1*c*, 1*d* operates in an extended position in which pressurized air initially forces piston 102 laterally from cylinder 101 in trench applications. Other applications, such as vehicles and buildings, require manual extension.

To maintain an extended lateral piston position in pneumatic and non-pneumatic applications, the operator first manually rotates outer ratcheting collar 107, or outer cam collar 107*t*, clockwise until a specific aperture 128, 129, 130, 131 is closest to sloping camming surface 107*i* or 107*h*. Please see FIG. 7(129*a*/131*a*).

He or she then inserts tethered metal camming pin 170 within that closest piston aperture and through its 180-degree opposing piston aperture. For example, if the operator inserts camming metal pin 170 through piston aperture 128*b*, then straight camming metal pin 170 also inserts within opposing piston aperture 130*b*. The operator continues to rotate outer ratcheting collar 107 or outer cam collar 107*t* clockwise until metal camming pin 170 firmly abuts the closest sloping camming surface 107*i* or 107*j*, as the case may be.

For prototype 1*d* the operator obtains a maximum tight fit by continuing to rotate outer ratcheting collar 107 clockwise until rectangular protrusion 119 engages a serration 114 (as evidenced by a clicking sound). Without additional pressurized air flowing to shoring device 1*d* cylinder 101 and piston 102 remain laterally extended, because outer ratcheting collar 107 and inner ratcheting ring 113 prevent counter-clockwise rotational piston movement and subsequent slippage from cylinder 101.

To disengage outer ratcheting collar 107 the operator rotates outer ratcheting collar 107 in a counter-clockwise direction while manually depressing mechanical thumblock 126. At this point, locking rectangular protrusion 119 disengages from engaged serration 114. He continues to rotate outer ratcheting collar 107 until metal camming pin 170 no longer abuts either sloping camming surface 107*i*, 107*j*. The operator then removes metal camming pin 170.

To rotate outer ratcheting collar 107 counterclockwise, the operator must keep manual pressure on thumblock 126. This manual pressure maintains rectangular protrusion 119 in a retracted position relative to serrations 114. Vent holes 112 within cylinder wall 101*d*, release gas from cylinder 101 whenever piston 102 extends from cylinder 101 sufficiently for piston rubber endcup 156 to pass beyond vent holes 112. As a result of vent holes 112, no further extension of shoring device 100 occurs, because the air pressure dissipates. The preferred number of vent holes 112 is four, but other numbers are also satisfactory.

To maintain this extended lateral piston position in pneumatic and non-pneumatic applications of prototype 1*c*, the operator first manually rotates outer cam collar 107*t* clockwise, until a specific aperture 128, 129, 130, 131 is closest to sloping cam surface 107*i* or 107*h*. Please see FIG. 7 (129*a*/131*a*). He or she then inserts tethered metal cam pin 170 within that closest piston aperture and through its 180-degree opposing piston aperture.

For example, if the operator inserts straight cam metal pin 170 through piston aperture 128*b*, then straight cam metal pin 170 also inserts within opposing piston aperture 130*b*. The operator continues to rotate outer cam collar 107*t* clockwise until straight metal cam pin 170 firmly abuts the closest sloping cam surface 107*i* or 107*j*, as the case may be. After abutment occurs, the operator obtains a maximum tight fit by rotating threaded pin 181 until he or she detects the maximum pressure that furthermost point 180*e* can exert against indentation floor 113*d*.

Without additional pressurized air flowing to my shoring device 1*c* cylinder 101 and piston 102 remain laterally extended, This extension continues because outer cam collar 107*t* and inner cam ring 113*h* prevent counter-clockwise rotational piston movement and subsequent slippage from cylinder 101. To disengage outer cam collar 107*t* the operator rotates outer cam collar 107*t* in a counter-clockwise direction and releases threaded pin 181 by rotating pin handle 181*b* counter clockwise. He or she continues to rotate outer cam collar 107*t* until straight metal cam pin 170 no longer abuts either sloping cam surface 107*i*, 107*j*. The operator then removes straight metal cam pin 170.

In both proptotypes 1*c*, 1*d* vent holes 112 within cylinder wall 101*d*, release gas from cylinder 101 whenever piston 102 extends from cylinder 101 sufficiently for piston rubber end cup 156 to pass beyond vent holes 112. As a result of vent holes 112, no further extension of shoring device 1*c*, 1*d* occurs, because the air pressure dissipates. The preferred number of vent holes 112 is four, but other numbers are also satisfactory.

Installation of Multiple Shoring Devices 1*c*, 1*d* within an Excavation or Trench The operator always installs a plurality of my improved shoring devices 1*c*, 1*d* in progression from the top of the trench to the bottom of the trench. The best mode of installation and removal procedure proceeds as follows:

1. The operator initially determines appropriate shoring configurations according to 29 C.F. 1926.652(Federal Register, Vol. 54(209): 45961-62, Oct. 31, 1989)(Requirements for protective systems). Under this regulation, the engineer's data determines whether wooden boards, wooden boards with posterior plywood sheets, or aluminum wale-plates are necessary in a specific shoring operation.

For example:

(a) The installer can position a wooden board which is approximately 2 inches thick by 10 inches wide (designated as an "upright" in this industry) on each opposing trench wall surface. The operator can force these boards further into each trench wall using pressurized air, infra. Please see FIG. 1. The length of these boards varies, depending upon the dimensions of a trench or other application.

(b) In other circumstances, the operator can position an approximately 12-inch tall aluminum wale-plate at each end of shoring device 1*c*, 1*d*. These wale-plates are approximately six inches wide and approximately 2 and ½ inch in thickness, and they eliminate the need for upright wooden boards.

(c) The operator then selects the proper size and number of shoring devices 1*c*, 1*d* required to shore or prop the trench effectively. The installer positions plywood, timber uprights or aluminum wale-plates as required after he has descended into the trench, infra. FIG. 1 illustrates a plurality of shoring devices 1*c* within a trench, and in which shoring devices 1*c* support first and second wooden shoring boards and/or aluminum wale-plates.

2. The operator next determines that outer cam collar 107*t* or outer ratcheting collar 107 is properly positioned over inner ratcheting ring 113 or inner ring 113*h*, depending upon whether prototype 1*c* or 1*d* is installed. Prior to installation, the installer will often place tethered camming metal pin 170 into one piston aperture 128, 129, 130, 131 to prevent camming metal pin 170 from dangling. However, the installer must remove tethered camming metal pin 170 prior to pressurizing shoring device prototypes 1*c*, 1*d* or pin 170 will prevent full extension of piston 102.

(a) The installation pressure is the air pressure required to expand piston 102 laterally from cylinder 101, thus forcing the upright wooden boards and/or aluminum wale-plates into opposing trench walls with attached removal swivel side plates 103*s*, 103*t*. The best mode of installing shoring device prototypes 1*c*, 1*dd* requires an installation pressure of approximately 115 to 225 pounds per square inch.

(b) Under this compressed gas or air pressure, piston 102 extends laterally and distally until both removable swivel side plates 103*s*, 103*t* bear against the wooden shoring boards and/or or wale-plates. First set screw 120*a* and second set screw 120*b* quickly engage the wooden shoring boards or aluminum wale-plates after introduction of pressurized air, thus preventing board or wale-plate random movement (c) In the best mode of use and installation, there are at least two shoring device prototypes 1*c*, 1*d* within one trench whenever shoring device prototypes 1*c*, 1*d* are the sole protection from wall collapse. For trenches with a depth greater than eight feet, in the best mode there should be a shored length of trench at least equal to its depth. For example, a trench that is twenty feet long and nine feet deep should have at least nine feet of its length shored, or propped, by shoring device prototypes 1*c*, 1*d*.

3. The operator next places a ladder in the trench and descends until his waist is even with the top of the trench. Third persons outside the trench assist by lowering the shoring device prototype 1*c* or 1*d* to the descended operator with either a rope or webbing.

The installer now positions shoring device prototype 1*c* or 1*d* to the required or desired depth (i.e., no deeper than two feet for the uppermost initial placement, and then no greater than four feet thereafter) within the trench, but he himself does not descend into the trench below his waist. The installer levels shoring device prototype 1*c*,1*d* to the horizontal (i.e., parallel to the floor of the trench) and authorizes air pressure to shoring device prototype 1*c*, 1*d* from third persons. This air pressure results in immediate lateral extension of piston 102 within cylinder 101.

4. Vent holes 112 give an audible indication whenever piston 102, which must remain within cylinder 101, reaches its maximum extended position. This indication occurs whenever approximately ⅓ of piston 102 remains within cylinder 101. At this time, if additional shoring device prototype 1*c*, 1*d* length is required, then the operator obtains a shoring device prototype 1*c*,1*d* with a greater lateral extension.

(a) With piston 102 now fully extended from applied air pressure, the operator rotates outer ratcheting collar 107 or outer cam collar 107*t* clockwise, until a piston aperture 128, 129, 130, or 131 is closest to a sloping camming surface 107*i*, 107.

(b) He then inserts a metal camming pin 170 through this piston aperture and its 180-degree opposing counterpart, such as 128*c*/130*c*, 129*b*/131*b*, as examples. The operator continues to rotate outer ratcheting collar 107 or outer cam collar 107*t* until camming metal pin 170 firmly abuts either sloping camming surfaces 107*i* or 107*j*.

5. For outer ratcheting collar prototype 1*d*, immediately after metal camming pin 170 engages either sloping camming surface 107*i*, 107*j* the operator continues to rotate outer ratcheting collar 107 until rectangular protrusion 119 engages a serration 114 for prototype 1*d*. This result occurs because mechanically engaged inner ratcheting collar 107 and inner ratcheting ring 113 are (i) tightly locked to each other and (ii) tightly locked against piston 102 and cylinder 101 in prototype 11*d*. This tightly locked combination also presses stopfaces 107*i*, 107*j* and camming surfaces 107*f* and 107*g* directly against piston 102.

Inner ratcheting ring 113 also grasps piston 102 directly and is braced against counterclockwise rotational force by screws, which connect inner ratcheting ring 113 to cylinder 101. Please see FIG. 18. In addition, camming metal pin 170 prevents piston 102 from retracting into cylinder 101 or collapsing onto the trench floor.

6. Once outer ratcheting collar 107 and inner ratcheting ring 113 engage, or outer cam collar 107*t* and inner ring 113*h* more tightly engage by threaded pin 180, the operator signals third persons to remove exterior air pressure from the now extended shoring device prototype 1*c*, 1*d* as the case may be. The air hose is then removed from the leveled shoring device 1*c*, 1*d* to attach to another shoring device prototype 1*c*, 1*d*. Shoring device 1*c*, 1*d* is now in its extended longitudinal position, and its removable swivel side plates 103*s*, 103*t* engage opposing wood shoring boards and/or aluminum wale-plates with set screws 120.

7. Now that the first shoring device is installed, the installer can further descend the ladder within the trench, until his waist is even with the level of this initial installed shoring device 1*c* or 1*d*. He then prepares to install a second shoring device 1*c* or 1*d* deeper within the trench. As the operator progresses deeper into the trench, his next "level of protection" is waist height with the last installed shoring device 1*c* or 1*d*.

In the best mode of applying improved shoring device 1*c* or 1*d*, the operator uses two-inch by ten-inch Douglas fir timber uprights or aluminum 12-inch wale-plates. Aluminum wale-plates are positioned horizontally or vertically. Plywood, timber uprights, and 12-inch wale-plates are all satisfactory, as long as these items continuously contact trench walls with no gaps or voids. Plywood sheeting is required in all trenches, regardless of depth, if the operator observes sloughing or raveling (movement of soil around or between shoring elements).

In the best mode and preferred embodiment, shoring device prototypes 1*c* and 1*d* are strongest whenever the operator positions it completely horizontally within the trench. However, in other embodiments shoring device prototypes are most effective when positioned vertically. With these embodiments, base plates replace removable swivel side plates 103*s*, 103*t* for shoring device vertical positions. For example, with a single or a plurality of shoring devices, a vertical position (or small angle from the vertical) from the supporting flat surface is recommended for shoring of a vehicle or structure such as a house. In the preferred embodiment a shoring device is installed at an angle which deviates from the horizontal no more than 15 degrees.

Depending upon the circumstances, the engineer may require plywood in addition to either wooden upright boards or wale-plates. Where plywood is necessary, it is preferably 1 and ⅛ inch Douglas fir or 14-ply white birch. Douglas fir is a tree species, while a "number 2" designation refers to the wood quality and grade. These particular designations are well known in the rescue industry, as well as the lumber industry. The plywood must be at a minimum: 1 and ⅛ inch thick, approximately four feet wide and approximately eight feet long.

Alternatively, the installer can use the 14-ply (fourteen layers glued or laminated together) white birch plywood, which is approximately ¾ inch thick, four feet wide and eight feet in length. Other dimensions are also within the scope of my invention, as the operator is not limited to a certain plywood size.

Removal of Multiple Shoring Devices 1*c*, 1*d* within an Excavation or Trench In a reverse chronology of the installation described immediately supra, the operator always removes a plurality of shoring device prototypes 1*c*, 1*d* from the trench bottom to the upper trench edge. In this manner, the operator remains waist high to the last extended installed shoring device prototype 1*c*, 1*d* within a trench. An operator at this "level of protection" is either completely exterior to the trench or at the level of the next highest fully installed shoring device prototype 1*c*, 1*d*. At the proper level, the operator next follows these steps:

1. Prior to disengagement and removal of each shoring device prototype 1*c*, 1*d*, air pressure is re-introduced through gas inlet 111 by a method well known in this particular industry. After re-introduction of air pressure, the operator depresses thumblock 126 and then rotates outer ratcheting collar 107 counter-clockwise to disengage rectangular locking protrusion 119 from serration 114. With prototype 1*c*, threaded pin 181 is rotated until it loosens and separates from indentation floor 113*j*. Each shoring device prototype 1*c*, 1*d* requires the same pressure upon removal from the trench, as it did when it was originally installed.

2. For both prototypes 1*c*, 1*d*, the operator continues counter-clockwise rotation of outer ratcheting collar 107 until metal camming pin 170 no longer abuts either sloping camming surface 107*i* or 107*j*. He then removes metal camming pin 170 from the appropriate piston apertures. The operator must remove metal camming pin 170 to retract shoring device prototype 1*c*, 1*d*.

(a) Shoring device 1*c*, 1*d* does not collapse at this point, because the air pressure provides continuing extension of piston 102. Without the continuing air pressure to this now pinless shoring device prototype 1*c*, 1*d* the trench wall could collapse.

(b) With the air pressure still connected to gas inlet 111, the operator now ascends the ladder to either remove another shoring device prototype 1*c*, 1*d* or exit the trench. After the operator is in a safe position, the air pressure through gas inlet 111 is removed, and third persons assist in lifting this particular shoring device prototype 1*c*, 1*d* from the trench with rope or a webbing material.

Wherever possible, back filling replaces soil which was removed from a trench prior to the above-described operation. In the best mode of using my shoring device prototype 1*c*, 1*d*, back filling is recommended after all shoring device prototypes 1*c*, 1*d* are removed from the trench, and after the trench operation is complete. In the best mode, for trenches with a depth greater than eight feet, the length of the trench shored should equal the actual trench depth. Back filling can also be by concrete or wooden blocks. Backfilling should occur as each shoring device prototype 1*c*, 1*d* is removed.

Operators should not use shoring device prototypes 1*c*, 1*d* within trenches, which are wider than 15 feet or at a depth other than five to twenty feet. For depths greater than twenty feet, a registered engineer should recommend the appropriate wood or wale-plate shoring requirements.

Materials Comprising Shoring Device Prototypes 1*c*, 1*d*

The strength of the materials used in my components of my improved shoring device prototypes 1*c*, 1*d* is crucial to the physical characteristics of its structure and design:

(1) The preferred metal pins are available from:

PivotPoint

P.O. Box 488

Hustisford, Wis. 53034

The pin comprising rotating hinge 125 is straight and round, and is in effect a round roll pin.

Camming metal pins 170 have round "key rings" at the upper end of each pin to prevent slippage through piston 102. The recommended models are:

(a) ⅝ inch by 3.5-inch detente ring pins 105*c* with a collar (12L14Carbon Steel Zinc w/yellow chromate finish or stainless steel), where ⅝ inch is the diameter of the pin shaft;

(b) ⅝ inch by four and ¾ inch ring pin with collars (Grade 5, 1144 carbon steel with zinc and yellow chromate finish); and (c) 5/32×1 and ¼ inch, 4-20 stainless steel slotted spring pin.

Detente pins 105*a*, 105*b* with small detente beads 45 (See FIG. 3), are preferably made of carbon steel or stainless steel.

(2) Aluminum sand casted components such as inner ratcheting ring 113, outer ratcheting collar 107, cylinder plug 155 and swivel sideplates 103*a*, 103*b* are custom made by:

Louis Meskan Foundry 2007-13 North Major Ave.

Chicago, Ill. 60639

These 356-T components are made by initially pouring molten metal into a mold and are designated in the industry as "sand castings."

(3) Aluminum extruded cylinders 101, pistons 102 and 12-inch aluminum wale-plates are custom made by:

Precision Extrusions

720 East Green Street

Bensenville, Ill. 60106

The preferred material for cylinder 101 is aluminum type 6061-T6, which is extruded, and the dipped in cold water during a process well known in this particular industry. The pistons 102 and wale-plates are also of the 6061-T6 variety.

(4) Circular rubber (55 durometer neoprene) endcups 155*b*, 156 are custom-made by:

Packing Seals, Inc.

3507 North Kenton Ave.

Chicago, Ill. 60641

(5) The polyvinylchloride coated stainless steel lanyard 145 which connects metal camming pin 170 to outer ratcheting collar 107 is available from:

Lexco Cable

2738 West Belmont Ave.

Chicago, Ill. 60618

Model: 3/32, 7×7 G.A.C. (galvanized aircraft cable) coated with 3/16 clear polyvinyl chloride (6) The double torsion spring 125*a* along rotating hinge/roll pin 125 is available from:

Micromatic Spring Co.

9325 King Street

Franklin Park, Ill. 60131

Model: 0.062 diameter 302 SS double torsion stainless steel spring

The small springs 84 and détente spheres 997 are available from:

Aerofast Co.

Carol Stream, Ill.

Preferred small springs 84 are approximately ½ inch in length when not stretched or compressed, and are approximately ⅝ inch in coil diameter.

The above is a description of the preferred embodiment of my improved shoring device 1*c*, 1*d* as well as the best mode of its application. However, these skilled in the art may envision other possible variations within the invention's scope, by changing the dimensions and shapes of its components. Accordingly, since my invention is possible in other specific forms without departing from the spirit or essential characteristics thereof, the embodiments described herein are considered in all respects illustrative and not restrictive.

I claim:

1. A shoring device comprising:

(A) a piston and a cylinder, said cylinder partially enclosing said piston, said piston said cylinder and said piston both having a longitudinal axis, said piston and said cylinder each comprising a distal end and a proximal end, said cylinder comprising opposing cylinder apertures, said piston comprising opposing piston apertures, (B) a mechanical device, said mechanical device positioned along said piston and said cylinder for retention of said piston against rotation of said piston during an expanded condition, wherein said mechanical device comprises in combination, (1) an outer collar, said outer collar comprising a locking member, said outer collar movably positioned along the longitudinal axis of said piston, and (2) an inner ring, said inner ring fixedly encircling said cylinder, said outer collar concentrically enclosing said inner ring, said outer collar engaging said cylinder, said piston and said inner ring in a revolving manner, said locking member contacting said inner ring, whereby said outer collar is prevented from rotation by said locking member, said shoring device comprising removable swivel side plates, said removable swivel side plates comprising détente sphere attachments, whereby said detente sphere attachment connects said removable swivel side plates to said cylinder and said piston.

2. The shoring device as described in claim 1, wherein each said détente sphere attachment comprises a depression containing a small single spring and one détente sphere.

3. The shoring device as described in claim 2, wherein each depression is circular and comprises two notches, said notches opposing each other at approximately 180 degrees.

4. A shoring device as described in claim 3, wherein said détente sphere is made of stainless steel and is approximately ⅝ inch in diameter.

5. The shoring device as described in claim 4 wherein said détente sphere is compressible into, and permanently lodged within said circular depression, said detente sphere adapted to retract into said circular depression whenever said détente sphere is compressed, said single small spring adapted to bias said detente sphere to protrude from said depression, whereby said détente sphere automatically rebounds from said compression when said compression is released.

6. The shoring device as describe in claim 5 wherein said two said détente sphere attachments are located within said central segment of each said removal swivel side plate, said detente sphere attachments opposing each other at approximately 180 degrees.

7. The shoring device as described in claim 6 wherein each said détente sphere attachment is congruently aligned with said opposing piston apertures or said opposing cylinder apertures.

* * * * *